US010662829B2

(12) United States Patent
Iwasaki et al.

(10) Patent No.: US 10,662,829 B2
(45) Date of Patent: May 26, 2020

(54) VALVE TIMING ADJUSTMENT DEVICE

(71) Applicant: DENSO CORPORATION, Kariya, Aichi-pref. (JP)

(72) Inventors: Akira Iwasaki, Kariya (JP); Genki Suzuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/173,124

(22) Filed: Oct. 29, 2018

(65) Prior Publication Data

US 2019/0136723 A1 May 9, 2019

(30) Foreign Application Priority Data

Nov. 6, 2017 (JP) ..... 2017-214062
Sep. 21, 2018 (JP) ..... 2018-177644

(51) Int. Cl.

| | |
|---|---|
| ***F01L 1/34*** | (2006.01) |
| ***F01L 1/352*** | (2006.01) |
| ***F01L 1/348*** | (2006.01) |
| *F01L 1/053* | (2006.01) |
| *F01L 1/02* | (2006.01) |

(52) U.S. Cl.

CPC ..... *F01L 1/352* (2013.01); *F01L 1/348* (2013.01); *F01L 1/024* (2013.01); *F01L 2001/0537* (2013.01); *F01L 2103/00* (2013.01); *F01L 2103/01* (2013.01); *F01L 2250/02* (2013.01); *F01L 2250/04* (2013.01); *F01L 2820/032* (2013.01)

(58) Field of Classification Search

CPC . F01L 1/344; F01L 1/348; F01L 1/352; F01L 2250/02; F01L 2250/04

USPC ..... 123/90.15, 90.17

See application file for complete search history.

(56) References Cited

U.S. PATENT DOCUMENTS

| | | | | |
|---|---|---|---|---|
| 8,245,679 | B2 * | 8/2012 | Morishima | F01L 1/344 123/90.15 |
| 2009/0038570 | A1 | 2/2009 | Schafer et al. | |
| 2009/0199801 | A1 | 8/2009 | Imai et al. | |
| 2009/0301416 | A1 | 12/2009 | Watanabe | |

FOREIGN PATENT DOCUMENTS

| | | |
|---|---|---|
| JP | 2017-115601 | 6/2017 |

* cited by examiner

*Primary Examiner* — Ching Chang
(74) *Attorney, Agent, or Firm* — Nixon & Vanderhye P.C.

(57) ABSTRACT

A housing is rotatable synchronously with a crankshaft of an engine. A plurality of external teeth arrangements is respectively shaped into a ring form and is formed integrally with the housing in one piece and is configured to mesh with a plurality of chains, respectively, each of which is wound around the crankshaft or a sprocket that is rotatable. A cam plate is connected to a camshaft of the engine and is rotatable relative to the housing. A plurality of stoppers is formed integrally with the housing in one piece while the stoppers are configured to limit relative rotation between the housing and the cam plate within a predetermined range when the stoppers contact the cam plate. Each stopper is placed at a position, at which the stopper does not overlap with any of the external teeth arrangements in a view taken in an axial direction of the housing.

13 Claims, 17 Drawing Sheets

VALVE TIMING ADJUSTMENT DEVICE

CROSS REFERENCE TO RELATED APPLICATION

This application is based on and incorporates herein by reference Japanese Patent Application No. 2017-214062 filed on Nov. 6, 2017 and Japanese Patent Application No. 2018-177644 filed on Sep. 21, 2018.

TECHNICAL FIELD

The present disclosure relates to a valve timing adjustment device.

BACKGROUND

Previously, there is known a valve timing adjustment device that includes: a housing, which is rotated synchronously with a driving-side shaft of an internal combustion engine; and a cam plate, which is connected to a driven-side shaft. In this valve timing adjustment device, the housing and the cam plate are rotated relative to each other to adjust valve timing of valves of the internal combustion engine. For example, in the valve timing adjustment device of JP2009-185785A (corresponding to US2009/0199801A1), the housing is divided into two parts in an axial direction, and one of the housings, which is placed on the driven-side shaft side, has two external teeth arrangements that are configured to mesh with endless transmission members, respectively, which are wound around, for example, the driving-side shaft and/or the like. Furthermore, the other one of the housings, which is located on an opposite side that is opposite from the driven-side shaft, has a plurality of stoppers that are configured to limit the relative rotation between the housing and the cam plate in a predetermined range.

SUMMARY

If the housing, which includes the external teeth arrangements, and the housing, which includes the stoppers, are formed integrally in one piece by, for example, cutting a blank material, the productivity may become relatively low, and the manufacturing costs may be disadvantageously increased. In contrast, in the valve timing adjustment device of JP2009-185785A, the housing is divided into the housing, which includes the external teeth arrangements, and the housing, which includes the stoppers, so that the productivity is improved.

However, in the valve timing adjustment device of JP2009-185785A, the number of the housings is two, so that management costs are added, and thereby it is difficult to further reduce the manufacturing costs.

It is an objective of one aspect of the present disclosure to provide a valve timing adjustment device that can improve productivity of the valve timing adjustment device.

Furthermore, JP2017-115601A discloses a valve timing adjustment device that includes an Oldham coupling, which is configured to be movable relative to the housing. The Oldham coupling is configured to transmit rotation, which is inputted from an outside, to the cam plate and is configured to implement relative rotation between the housing and the cam plate. In this valve timing adjustment device, an external teeth arrangement, which is shaped into a ring form and can be meshed with an endless transmission member, and an engaging portion, which is engageable and is slidable relative to the Oldham coupling, are formed integrally with the housing in one piece. Here, the single external teeth arrangement is formed at the housing. If a plurality of external teeth arrangements is formed at the housing to conform to the number of endless transmission members, the engaging portion may possibly overlap with one of the plurality of external teeth arrangements in a view taken in the axial direction of the housing.

It is conceivable to integrally form the housing, at which the external teeth arrangement is formed, and the housing, at which the engaging portion is formed, by, for example, powder metallurgy to improve the productivity. Here, in the case where the engaging portion overlaps with the external teeth arrangement in the view taken in the axial direction of the housing, there is a possibility of that a molding die, which is used to mold the engaging portion, and a molding die, which is used to mold the external teeth arrangement, cannot be appropriately separated from each other. In such a case, there is a possibility of that the amount of compression of metal powder at corresponding portions of a compact of the metal powder, which respectively correspond to the engaging portion and the external teeth arrangement, becomes insufficient. In this case, a required density of the corresponding portions of the compact, which respectively correspond to the engaging portion and the external teeth arrangement, may not be satisfied, and thereby there is a possibility of deteriorating a strength of the engaging portion and the external teeth arrangement of the housing after sintering of the compact.

It is an objective of another aspect of the present disclosure to provide a valve timing adjustment device that can improve productivity of the valve timing adjustment device while ensuring a required strength of a housing after sintering.

According to one aspect of the present disclosure, there is provided a valve timing adjustment device configured to adjust valve timing of a valve of an internal combustion engine. The valve timing adjustment device includes a housing, a plurality of external teeth arrangements, a cam plate and a stopper. The housing is rotatable synchronously with one of a driving-side shaft and a driven-side shaft of the internal combustion engine. The external teeth arrangements are respectively shaped into a ring form and are formed integrally with the housing in one piece. The external teeth arrangements are configured to mesh with a plurality of endless transmission members, respectively, each of which is wound around the driving-side shaft or another member that is rotatable.

The cam plate is connected to the other one of the driving-side shaft and the driven-side shaft and is rotatable relative to the housing. The stopper is formed integrally with the housing in one piece. The stopper is configured to limit relative rotation between the housing and the cam plate within a predetermined range when the stopper contacts the cam plate. As described above, according to the present aspect, the housing, at which the external teeth arrangements are formed, and the housing, at which the stopper is formed, are integrally formed in one piece as one component. Therefore, the number of the components can be reduced to reduce the management costs in comparison to the case where the housing is divided into the two parts like in the prior art technique.

It is conceivable that the housing, at which the external teeth arrangements are formed, and the housing, at which the stopper is formed, are formed integrally in one piece by, for example, powder metallurgy to further improve the productivity. Here, in the case where the stopper overlaps with one of the external teeth arrangements in the view taken in the axial direction of the housing, there is a possibility of that a molding die, which is used to mold the stopper, and a molding die, which is used to mold the external teeth arrangement, cannot be appropriately separated from each other. In such a case, there is a possibility of that the amount of compression of metal powder at corresponding portions of a compact of the metal powder, which respectively correspond to the stopper and the external teeth arrangement, becomes insufficient. In this case, the required density of the corresponding portions of the compact, which respectively correspond to the stopper and the external teeth arrangement, may not be satisfied, and thereby there is a possibility of deteriorating the strength of the stopper and the external teeth arrangement after the sintering.

In the present aspect, the stopper is placed at the position, at which the stopper does not overlap with any of the external teeth arrangements, in the view taken in the axial direction of the housing. Therefore, for example, the molding die used in the powder metallurgy can be divided into the molding die for molding the stopper and the molding die for molding the external teeth arrangement. Thereby, the metal powder at the corresponding portions of the compact, which correspond to the stopper and the external teeth arrangement, can be sufficiently compressed. In this way, the required density of the corresponding portions of the compact, which correspond to the stopper and the external teeth arrangement, can be satisfied. Therefore, the productivity can be improved while achieving the required strength of the stopper and the external teeth arrangement after the sintering.

According to another aspect of the present disclosure, there is provided a valve timing adjustment device configured to adjust valve timing of a valve of an internal combustion engine. This valve timing adjustment device includes a housing, a plurality of external teeth arrangements, a cam plate, an Oldham coupling and an engaging portion. The housing is rotatable synchronously with one of a driving-side shaft and a driven-side shaft of the internal combustion engine. The external teeth arrangements are respectively shaped into a ring form and are formed integrally with the housing in one piece. The external teeth arrangements are configured to mesh with a plurality of endless transmission members, respectively, each of which is wound around the driving-side shaft or another member that is rotatable.

The cam plate is connected to the other one of the driving-side shaft and the driven-side shaft and is rotatable relative to the housing. The Oldham coupling is configured to implement relative rotation between the housing and the cam plate through the movement of the Oldham coupling relative to the housing when the rotation is inputted to the Oldham coupling from the outside. The engaging portion is formed integrally with the housing in one piece such that the engaging portion is engageable and is slidable relative to the Oldham coupling. As described above, according to the present aspect, the housing, at which the external teeth arrangements are formed, and the housing, at which the engaging portion is formed, are integrally formed in one piece as one component.

It is conceivable that the housing, at which the external teeth arrangements are formed, and the housing, at which the engaging portion is formed, are formed integrally in one piece by, for example, powder metallurgy to further improve the productivity. Here, in the case where the engaging portion overlaps with the external teeth arrangement in the view taken in the axial direction of the housing, there is a possibility of that a molding die, which is used to mold the engaging portion, and a molding die, which is used to mold the external teeth arrangement, cannot be appropriately separated from each other. In such a case, there is a possibility of that the amount of compression of metal powder at corresponding portions of a compact of the metal powder, which respectively correspond to the engaging portion and the external teeth arrangement, becomes insufficient. In this case, a required density of the corresponding portions of the compact, which respectively correspond to the engaging portion and the external teeth arrangement, may not be satisfied, and thereby there is a possibility of deteriorating a strength of the engaging portion and the external teeth arrangement of the housing after the sintering.

In the present aspect, the engaging portion is placed at the position, at which the engaging portion does not overlap with any of the external teeth arrangements, in the view taken in the axial direction of the housing. Therefore, for example, the molding die used in the powder metallurgy can be divided into the molding die for molding the engaging portion and the molding die for molding the external teeth arrangement. Thereby, the metal powder at the corresponding portions of the compact, which correspond to the engaging portion and the external teeth arrangement, can be sufficiently compressed. In this way, the required density of the corresponding portions of the compact, which correspond to the engaging portion and the external teeth arrangements, can be satisfied. Therefore, the productivity can be improved while achieving the required strength of the engaging portion and the external teeth arrangements of the housing after the sintering.

According to another aspect of the present disclosure, similar to the above-described other aspect, there is provided a valve timing adjustment device configured to adjust valve timing of a valve of an internal combustion engine. This valve timing adjustment device includes a housing, at least one external teeth arrangement, a cam plate, an Oldham coupling and an engaging portion. According to this aspect, the at least one external teeth arrangement is shaped into a ring form, and the at least one external teeth arrangement is formed integrally with the housing in one piece and is configured to mesh with at least one endless transmission member, which is wound around the driving-side shaft or another member that is rotatable.

The engaging portion is placed on a radially outer side of addendum parts of a radially outermost one of the at least one external teeth arrangement such that the engaging portion does not overlap with any of the at least one external teeth arrangement in a view taken in an axial direction of the housing. Therefore, similar to the above-described aspect, for example, the molding die used in the powder metallurgy can be divided into the molding die for molding the engaging portion and the molding die for molding the external teeth arrangement. Thereby, the metal powder at the corresponding portions of the compact, which correspond to the engaging portion and the external teeth arrangement, can be sufficiently compressed. In this way, the required density of the corresponding portions of the compact, which correspond to the engaging portion and the external teeth arrangement, can be satisfied. Therefore, the productivity can be improved while achieving the required strength of the engaging portion and the external teeth arrangement of the housing after the sintering.

BRIEF DESCRIPTION OF THE DRAWINGS

The present disclosure, together with additional objectives, features and advantages thereof, will be best understood from the following description in view of the accompanying drawings.

DETAILED DESCRIPTION

Hereinafter, a valve timing adjustment device according to various embodiments will be described with reference to the drawings. In the following embodiments, substantially the same constituent portions will be indicated by the same reference signs. In the following embodiments, substantially the same constituent portions will have the same or similar effects and advantages.

First Embodiment

Figure 1:
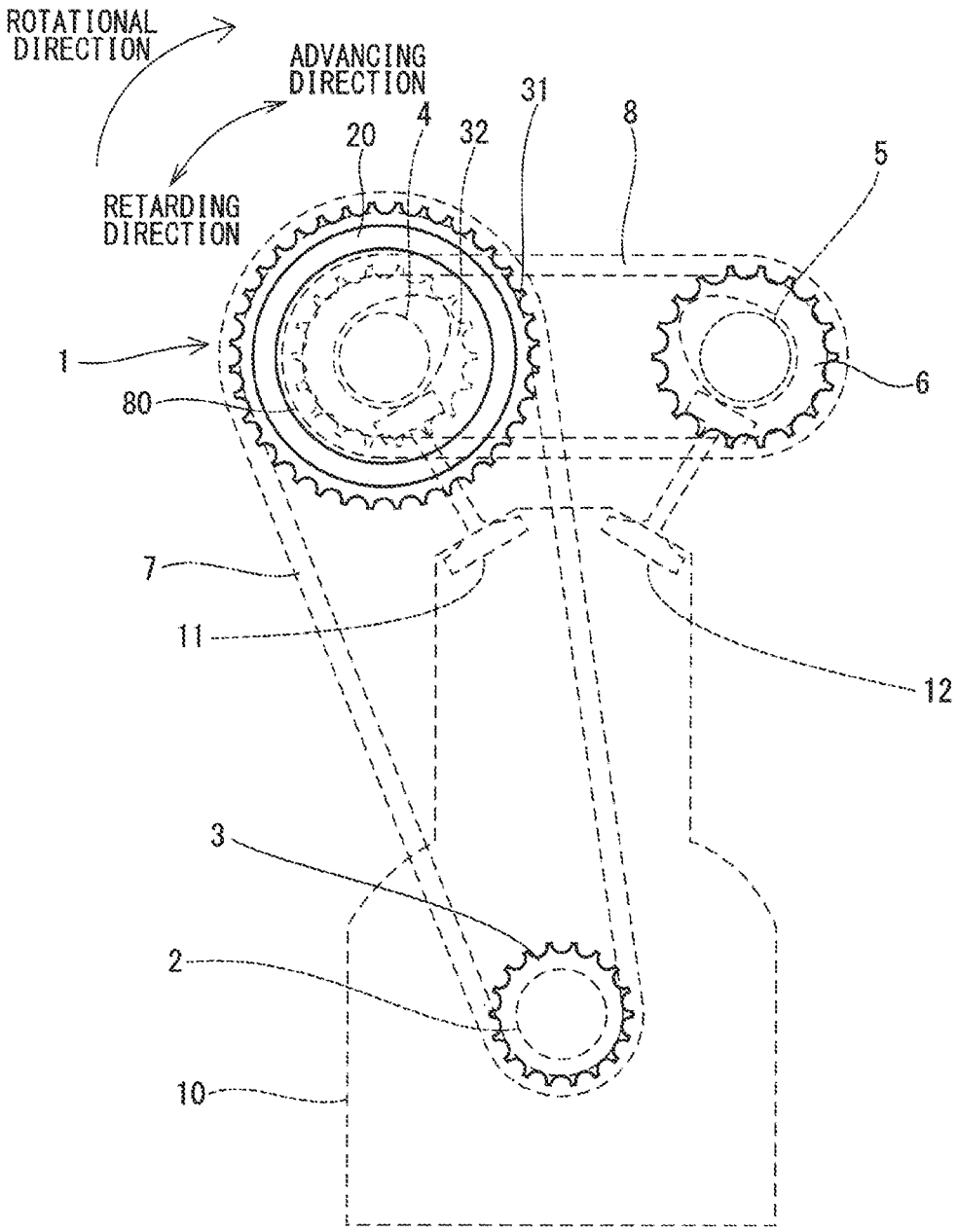
FIG. 1 is a schematic diagram showing an installed state of a valve timing adjustment device according to a first embodiment.
Figure 2:
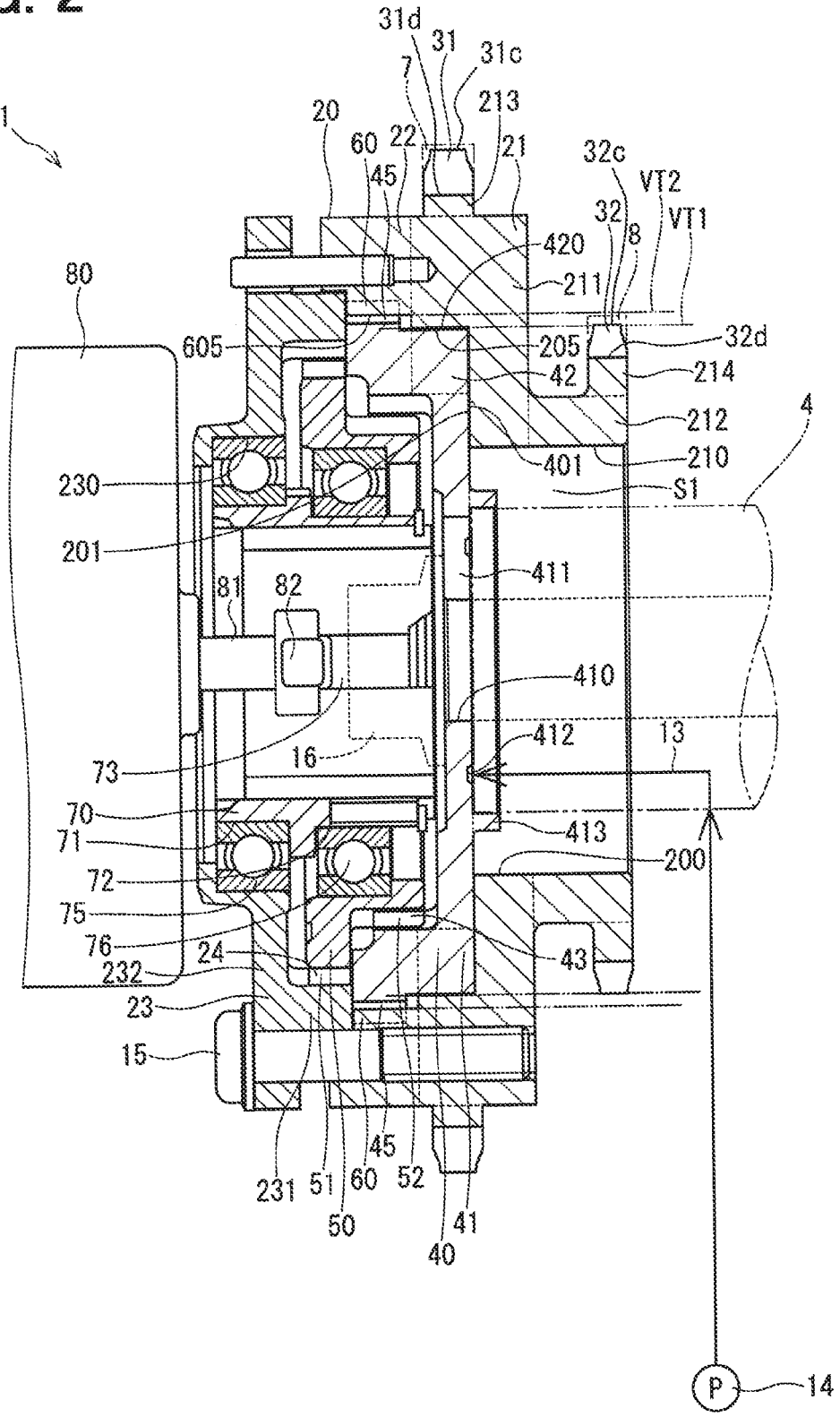
FIG. 2 is a cross-sectional view showing the valve timing adjustment device according to the first embodiment.

FIGS. 1 and 2 show a valve timing adjustment device of a first embodiment and a drive force transmission system of a vehicle having this valve timing adjustment device.

As shown in FIG. 1, in the drive force transmission system having the valve timing adjustment device 1 of the present embodiment, a chain 7 (serving as an endless transmission member) is wound around a sprocket 3, which is coaxially fixed to a crankshaft 2 (serving as a driving-side shaft) of an internal combustion engine (hereinafter referred to as an engine) 10, and an external teeth arrangement 31, which is coaxial with a camshaft 4 (serving as a driven-side shaft). A drive force is transmitted from the crankshaft 2 to the camshaft 4 through the chain 7 and the external teeth arrangement 31. Furthermore, a chain 8 (serving as an endless transmission member) is wound around an external teeth arrangement 32, which is coaxial with the external teeth arrangement 31, and a sprocket 6, which is coaxially fixed to a camshaft 5 (serving as a driven-side shaft). The drive force is transmitted from the crankshaft 2 to the camshaft 5 through the chain 7, the external teeth arrangement 31, the external teeth arrangement 32 and the chain 8.

The external teeth arrangement 31, which is described above, and a cam plate 40, which will be described later, form corresponding portions, respectively, of the valve timing adjustment device 1. The camshaft 4 opens and closes intake valves 11 (serving as valves), and the camshaft 5 opens and closes exhaust valves 12 (serving as valves). The valve timing adjustment device 1 of the present embodiment is an electric type that uses a motor 80 (described later) as a drive source. In the valve timing adjustment device 1, the external teeth arrangement 31 and the cam plate 40 are connected to the chain 7 and the camshaft 4, respectively, to adjust opening timing and closing timing of the intake valves 11.

As shown in FIG. 2, the valve timing adjustment device 1 includes a housing 20, the external teeth arrangement 31, the external teeth arrangement 32, the cam plate 40, a gear 50, a plurality of stoppers 60 and an input member 70.

The housing 20 includes an external teeth housing 21, a stopper housing 22 and a cover housing 23. The external teeth housing 21, the stopper housing 22 and the cover housing 23 are made of, for example, metal. In the present embodiment, the external teeth housing 21 and the stopper housing 22 are formed integrally in one piece. The cover housing 23 is formed separately from the external teeth housing 21 and the stopper housing 22. The external teeth housing 21 and the stopper housing 22 are formed integrally in one piece by, for example, powder metallurgy.

The external teeth housing 21 includes a housing plate portion 211, a housing tubular portion 212, a housing ring portion 213 and a housing ring portion 214. The housing plate portion 211 is shaped into a substantially circular plate form. A housing hole portion 200 extends through a center of the housing plate portion 211 in a plate thickness direction of the housing plate portion 211. An inner peripheral surface of the housing hole portion 200 is in a form of a substantially cylindrical surface.

The housing tubular portion 212 is formed integrally with the housing plate portion 211 in one piece such that the housing tubular portion 212 is in a tubular form and extends from an outer peripheral edge part of the housing hole portion 200 at a surface of the housing plate portion 211, which is located on one axial side. An inner peripheral surface of the housing tubular portion 212 is in a form of a substantially cylindrical surface. An inner diameter of the housing hole portion 200 and an inner diameter of the housing tubular portion 212 are equal to each other. Thereby, an inner peripheral surface 210, which is in a form of a substantially cylindrical surface, is formed at an inside of the housing hole portion 200 and the housing tubular portion 212.

The housing ring portion 213 is formed integrally with the housing plate portion 211 in one piece such that the housing ring portion 213 is in a ring form and extends in a radially outward direction from an outer peripheral surface of an opposite end part of the housing plate portion 211, which is opposite from the housing tubular portion 212. The housing ring portion 214 is formed integrally with the housing tubular portion 212 in one piece such that the housing ring portion 214 is in a ring form and extends in the radially outward direction from an outer peripheral surface of an opposite end part of the housing tubular portion 212, which is opposite from the housing plate portion 211.

The stopper housing 22 is formed integrally with the housing plate portion 211 in one piece such that the stopper housing 22 is in a substantially cylindrical tubular form and extends from an opposite surface of the housing plate portion 211, which is opposite from the housing tubular portion 212. The stopper housing 22 is coaxial with the housing tubular portion 212.

The cover housing 23 includes a cover tubular portion 231 and a cover bottom portion 232. The cover tubular portion 231 is in a substantially cylindrical tubular form. The cover bottom portion 232 is formed integrally with the cover tubular portion 231 in one piece such that the cover bottom portion 232 closes one end part of the cover tubular portion 231. A cover hole portion 230 extends through a center of the cover bottom portion 232 in a plate thickness direction of the cover bottom portion 232. An inner peripheral surface of the cover hole portion 230 is in a form of a substantially cylindrical surface. The cover housing 23 is formed such that an opposite end part of the cover tubular portion 231, which is opposite from the cover bottom portion 232, is joined to an opposite end part of the stopper housing 22, which is opposite from the external teeth housing 21. The cover housing 23 is coaxial with the stopper housing 22. The cover housing 23, the stopper housing 22 and the external teeth housing 21 are integrated together by bolts 15.

Figure 3:
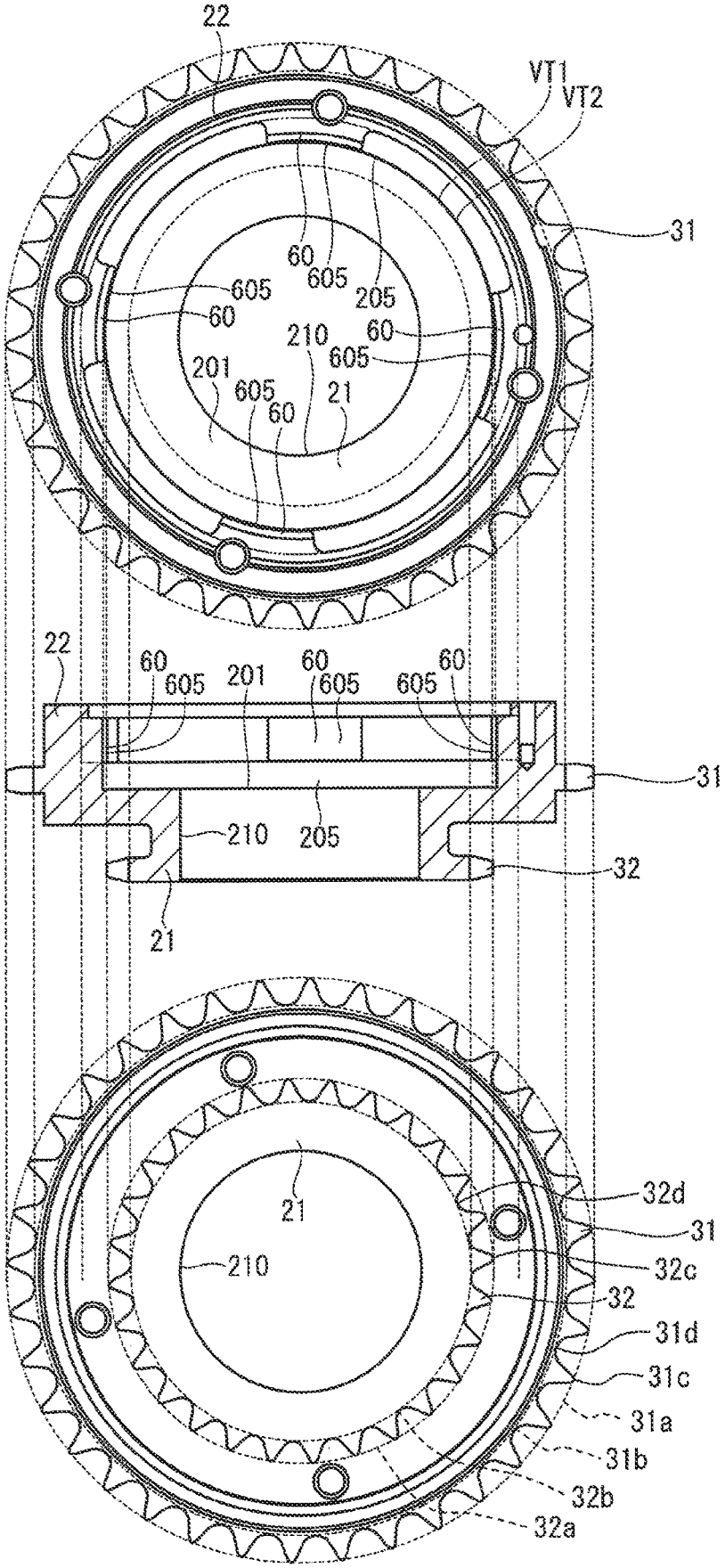
FIG. 3 is a diagram indicating a plan view, a cross-sectional view and a bottom view that respectively show a housing of the valve timing adjustment device according to the first embodiment.

The external teeth arrangement 31 is made of, for example, metal. The external teeth arrangement 31 is formed integrally with the external teeth housing 21 in one piece such that the external teeth arrangement 31 is in a ring form and is placed on a radially outer side of the housing ring portion 213. The external teeth arrangement 31 includes a plurality of external teeth, which are arranged one after the other in a circumferential direction (see FIG. 3). An upper section of FIG. 3 shows the external teeth housing 21 and the stopper housing 22 seen from the cover housing 23 side. A middle section of FIG. 3 shows a cross section of the external teeth housing 21 and the stopper housing 22 taken along a plane that include the axis. A lower section of FIG. 3 shows the external teeth housing 21 and the stopper housing 22 seen from an opposite side that is opposite from the cover housing 23. As discussed above, the chain 7, which is wound around the crankshaft 2, is wound around the external teeth arrangement 31. The external teeth arrangement 31 is configured to mesh with the chain 7. Thereby, when the crankshaft 2 is rotated, the drive force is transmitted to the housing 20 through the chain 7. Thus, the housing 20 is rotated synchronously with the crankshaft 2.

The external teeth arrangement 32 is made of, for example, metal. The external teeth arrangement 32 is formed integrally with the external teeth housing 21 in one piece such that the external teeth arrangement 32 is in a ring form and is placed on a radially outer side of the housing ring portion 214. The external teeth arrangement 32 includes a plurality of external teeth, which are arranged one after the other in the circumferential direction (see FIG. 3). As discussed above, the chain 8, which is wound around the sprocket 6, is wound around the external teeth arrangement 32. The external teeth arrangement 32 is configured to mesh with the chain 8. Thereby, when the crankshaft 2 is rotated, the drive force is transmitted from the crankshaft 2 to the sprocket 6 through the chain 7, the external teeth arrangement 31, the external teeth arrangement 32 and the chain 8. Thus, the camshaft 5 is rotated synchronously with the crankshaft 2.

The external teeth arrangement 31 and the external teeth arrangement 32 are coaxial with each other. A dedendum diameter (i.e., a diameter of a dedendum circle 31*b*) and an addendum diameter (i.e., a diameter of an addendum circle 31*a*) of the external teeth arrangement 31 are set to be larger than a dedendum diameter (i.e., a diameter of the dedendum circle 32*b*) and an addendum diameter (i.e., a diameter of the addendum circle 32*a*) of the external teeth arrangement 32. The external teeth arrangement 31 and the external teeth arrangement 32 are arranged one after the other and are spaced by a predetermined gap in the axial direction of the housing 20. Specifically, in the present embodiment, the number of the external teeth arrangements 31, 32 is two. The external teeth arrangement 31 and the external teeth arrangement 32 are processed through quenching treatment and thereby have increased hardness.

An external teeth arrangement is formed at an outer peripheral edge part of the sprocket 6 fixed to the camshaft 5. The number of external teeth of the external teeth arrangement of the sprocket 6 and the number of the external teeth of the external teeth arrangement 32 are equal to each other. Furthermore, a dedendum diameter and an addendum diameter of the external teeth arrangement of the sprocket 6 are the same as the dedendum diameter and the addendum diameter, respectively, of the external teeth arrangement 32.

The cam plate 40 includes a cam plate main body 41. The cam plate main body 41 is made of, for example, metal. In the present embodiment, the cam plate main body 41 is processed through quenching treatment and thereby has increased hardness.

The cam plate main body 41 is shaped into a bottomed tubular form. A tubular portion of the cam plate main body 41 is shaped into a substantially cylindrical tubular form. A plate hole portion 410 extends through a center of a bottom portion of the cam plate main body 41 in a plate thickness direction of the bottom portion of the cam plate main body 41. Furthermore, an extension hole portion 411 is formed in the cam plate main body 41. The extension hole portion 411 extends in the radially outward direction from the plate hole portion 410 (see FIG. 2). The bottom portion of the cam plate main body 41 includes an annular groove 412 that is in an annular form and is recessed from an end surface of the bottom portion of the cam plate main body 41, which is opposite from the tubular portion of the cam plate main body 41, on the radially outer side of a plate hole portion 410. The annular groove 412 is connected to the extension hole portion 411. Furthermore, a plate tubular portion 413 is formed on the radially outer side of the annular groove 412 at the bottom portion of the cam plate main body 41 as follows. Specifically, the plate tubular portion 413 is in a substantially cylindrical tubular form and extends from an end surface of the bottom portion of the cam plate main body 41, which is opposite from the tubular portion of the cam plate main body 41. The plate tubular portion 413 is formed to be coaxial with the tubular portion of the cam plate main body 41, the plate hole portion 410 and the annular groove 412.

The cam plate 40 is placed at the inside of the housing 20 such that the plate tubular portion 413 is placed on the inner side of the inner peripheral surface 210 of the housing 20, and the cam plate main body 41 is placed on the inner side of the stopper housing 22. Here, the outer diameter of the plate tubular portion 413 is set to be smaller than the inner diameter of the inner peripheral surface 210.

The housing 20 includes a contactable surface 201. The contactable surface 201 is formed at an opposite side of the housing plate portion 211, which is opposite from the housing tubular portion 212. The contactable surface 201 is contactable with a wall surface 401 of the bottom portion of the cam plate main body 41, which is opposite from the tubular portion of the cam plate main body 41. Specifically, the contactable surface 201 is an inner wall that is contactable with the wall surface 401 of the cam plate 40 located on the one side in the axial direction. In the present embodiment, the contactable surface 201 and the wall surface 401 are respectively formed in a form of substantially annular planar surface.

The cam plate 40 is connected to the camshaft 4 such that an end part of the camshaft 4 is fitted into the inside of the plate tubular portion 413. The cam plate 40 and the camshaft 4 are fixed together by a bolt 16 such that relative rotation between the cam plate 40 and the camshaft 4 is prevented. In this way, the cam plate 40 is rotated integrally with the camshaft 4. The cam plate 40 is rotatable relative to the housing 20. In the state where the cam plate 40 is connected to the camshaft 4, a gap, which is shaped into a substantially cylindrical form, is formed between an outer peripheral surface of the camshaft 4 and the inner peripheral surface 210 of the housing 20. Therefore, a load, which is radially inwardly exerted from the housing 20, is not directly applied to the outer peripheral surface of the camshaft 4.

In the present embodiment, a bearing portion 42 is formed at a portion of the cam plate main body 41. The bearing portion 42 is formed at an end part of the tubular portion of the cam plate main body 41, which is located on the side where the bottom portion of the cam plate main body 41 is placed. An outer peripheral surface 420 of the bearing portion 42 receives the load, which is radially inwardly exerted from the inner peripheral surface of the stopper housing 22 of the housing 20. Specifically, the bearing portion 42 rotatably supports the housing 20 through the outer peripheral surface 420. The outer peripheral surface 420 of the bearing portion 42 is in a form of a substantially cylindrical surface. A bearing inner peripheral surface 205, which is an inner peripheral surface of the housing 20 opposed to the outer peripheral surface 420, is shaped in a form of a substantially cylindrical surface. When the cam plate 40 and the housing 20 are rotated relative to each other, the outer peripheral surface 420 of the bearing portion 42 and the bearing inner peripheral surface 205 of the housing 20 slid relative to each other. The bearing inner peripheral surface 205 and the outer peripheral surface 420 of the bearing portion 42 are placed on the radially inner side of the external teeth arrangement 31. Therefore, when the load is radially inwardly applied from the chain 7 to the housing 20 through the external teeth arrangement 31, this radially inwardly applied load can be received by the bearing portion 42 of the cam plate 40.

A first internal teeth arrangement 24, which is shaped into a ring form, is formed at an inner peripheral wall of the cover tubular portion 231. The first internal teeth arrangement 24 includes a plurality of internal teeth, which are arranged one after the other in the circumferential direction. A second internal teeth arrangement 43, which is shaped into a ring form, is formed at an inner peripheral wall of the tubular portion of the cam plate main body 41. The second internal teeth arrangement 43 includes a plurality of internal teeth, which are arranged one after the other in the circumferential direction. The first internal teeth arrangement 24 and the second internal teeth arrangement 43 are coaxial with each other. A dedendum diameter and an addendum diameter of the first internal teeth arrangement 24 are set to be larger than a dedendum diameter and an addendum diameter of the second internal teeth arrangement 43.

The gear 50 is shaped into a substantially cylindrical tubular form and is made of, for example, metal. The gear 50 include a first external teeth arrangement 51 and a second external teeth arrangement 52. The first external teeth arrangement 51 and the second external teeth arrangement 52 are respectively shaped into a ring form and are formed at an outer peripheral wall of the gear 50. The first external teeth arrangement 51 and the second external teeth arrangement 52 are adjacent to each other and are coaxially arranged one after the other in the axial direction of the gear 50. A dedendum diameter and an addendum diameter of the first external teeth arrangement 51 are set to be larger than a dedendum diameter and an addendum diameter of the second external teeth arrangement 52.

The gear 50 is placed at the inside of the housing 20 such that the first external teeth arrangement 51 is meshed with the first internal teeth arrangement 24, and the second external teeth arrangement 52 is meshed with the second internal teeth arrangement 43. Specifically, the gear 50 is placed on the cover housing 23 side of the cam plate main body 41. Here, the dedendum diameter and the addendum diameter of the first external teeth arrangement 51 are set to be smaller than the dedendum diameter and the addendum diameter of the first internal teeth arrangement 24. Furthermore, the dedendum diameter and the addendum diameter of the second external teeth arrangement 52 are set to be smaller than the dedendum diameter and the addendum diameter of the second internal teeth arrangement 43.

The stoppers 60 are made of, for example, metal. The stoppers 60 are formed integrally with the stopper housing 22 in one piece such that the stoppers 60 radially inwardly project from the inner peripheral wall of the stopper housing 22. The number of the stoppers 60 is four, and these four stoppers 60 are arranged one after the other at equal intervals in the circumferential direction (see FIG. 3). The cam plate 40 includes a plurality of stopper projections 45. The stopper projections 45 are formed integrally with the cam plate main body 41 in one piece such that the stopper projections 45 project radially outward from an outer peripheral wall of the tubular portion of the cam plate main body 41. The number of the stopper projections 45 is four, and these four stopper projections 45 are arranged one after the other at equal intervals in the circumferential direction.

In the state where the cam plate 40 is placed at the inside of the housing 20, each of the stopper projections 45 is placed between corresponding adjacent two of the stoppers 60. When the cam plate 40 is rotated relative to the housing 20, a circumferential end part of each stopper projection 45 contacts a circumferential end part of the corresponding stopper 60. Thereby, the relative rotation of the cam plate 40 relative to the housing 20 is limited. Specifically, the stoppers 60 limit the relative rotation between the housing 20 and the cam plate 40 within a predetermined range. A predetermined gap is set between a distal end part of each stopper projection 45 and the inner peripheral wall of the stopper housing 22, and a predetermined gap is set between each stopper inner peripheral surface 605 (see FIGS. 2 and 3), which is a wall surface of a distal end part of the stopper 60, and the outer peripheral wall of the tubular portion of the cam plate main body 41. Therefore, when the cam plate 40 and the housing 20 are rotated relative to each other, the outer peripheral surface 420 of the bearing portion 42 and the bearing inner peripheral surface 205 of the housing 20 slide relative to each other. However, at this time, each stopper projection 45 and the inner peripheral wall of the stopper housing 22 do not slide relative to each other, and the stopper inner peripheral surface 605 of each stopper 60 and the outer peripheral wall of the tubular portion of the cam plate main body 41 do not slide relative to each other. As discussed above, the housing 20 is rotatably supported only by the bearing portion 42 among the bearing portion 42 of the cam plate 40 and the camshaft 4. Specifically, the bearing location for receiving the load in the radial direction of the housing 20 is only at one location, i.e., the bearing portion 42 in the axial direction of the housing 20.

The input member 70 is shaped into a tubular form and is made of, for example, metal. The input member 70 includes a first cylindrical surface 71 and a second cylindrical surface 72. The first cylindrical surface 71 and the second cylindrical surface 72 are respectively shaped into a form of a substantially cylindrical surface and are formed at an outer peripheral wall of the input member 70 such that the first cylindrical surface 71 and the second cylindrical surface 72 are arranged one after the other in the axial direction of the input member 70. The first cylindrical surface 71 is formed to be coaxial with an inner peripheral surface of the input member 70. The second cylindrical surface 72 is eccentric to the inner peripheral surface and the first cylindrical surface 71 of the input member 70.

The input member 70 is placed at the inside of the housing 20 such that the first cylindrical surface 71 is placed at an inside of the cover hole portion 230 of the cover housing 23, and the second cylindrical surface 72 is placed at the inside of the gear 50. A first bearing 75 is placed between the first cylindrical surface 71 and the cover hole portion 230. A second bearing 76 is placed between the second cylindrical surface 72 and the inner peripheral wall of the gear 50. With this construction, when the input member 70 is rotated relative to the housing 20, the gear 50 rotates about its axis and revolves relative to the housing 20 while the first external teeth arrangement 51 of the gear 50 is meshed with the first internal teeth arrangement 24, and the second external teeth arrangement 52 of the gear 50 is meshed with the second internal teeth arrangement 43. When the gear 50 rotates about its axis and revolves relative to the housing 20, the housing 20 and the cam plate 40 rotate relative to each other.

The motor 80 includes a motor shaft 81 and a plurality of joints 82. The motor shaft 81 is fixed to a rotor (not shown) and is rotated together with the rotor when the electric power is supplied to the motor 80. The joints 82 are fixed at a distal end part of the motor shaft 81 and are rotatable integrally with the motor shaft 81. The motor 80 is installed to the engine 10 such that with respect to the valve timing adjustment device 1, which is installed to the camshaft 4, the motor 80 is placed on an opposite side of the valve timing adjustment device 1, which is opposite from the camshaft 4. The supply of the electric power to the motor 80 is controlled by an undepicted electronic control unit (hereinafter, referred to as an ECU), so that the rotation of the motor 80 is controlled.

A plurality of joint grooves 73, which extend in the axial direction, is formed at the inner peripheral wall of the input member 70. The motor 80 is installed to the engine 10 such that the joints 82 are engaged with the joint grooves 73, respectively. Therefore, when the motor 80 is rotated by supplying the electric power to the motor 80, the input member 70 is rotated. When the input member 70 is rotated, the gear 50 is rotated about its axis and is revolved relative to the housing 20. Thereby, the housing 20 and the cam plate 40 rotate relative to each other. As discussed above, the gear 50 enables the relative rotation between the housing 20 and the cam plate 40 upon the rotation of the motor 80.

As shown in FIGS. 2 and 3, in the present embodiment, each of the stoppers 60 is placed at the corresponding position, at which the stopper 60 does not overlap with any of the external teeth arrangement 31 and the external teeth arrangement 32 in a view taken in the axial direction of the housing 20. Furthermore, in the view taken in the axial direction of the housing 20, the stoppers 60 are placed on the radially outer side of the addendum parts 32*c* of the external teeth arrangement 32 that is the radially innermost one among the two external teeth arrangements 31, 32. More specifically, in the view taken in the axial direction of the housing 20, the stoppers 60 are placed on the radially outer side of the addendum parts 32*c* of the external teeth arrangement 32 and on the radially inner side of the dedendum parts 31*d* of the external teeth arrangement 31 that is the radially outermost one among the two external teeth arrangements 31, 32. Furthermore, the external teeth arrangement 31 and the external teeth arrangement 32 are formed at corresponding locations, respectively, at which the external teeth arrangement 31 and the external teeth arrangement 32 do not overlap with each other in the view taken in the axial direction of the housing 20.

Furthermore, as shown in FIGS. 2 and 3, in the present embodiment, the bearing inner peripheral surface 205 is formed to extend along a first imaginary cylindrical surface VT1 that is in a form of a cylindrical surface, which is cylindrical about an axis of the housing 20. The stopper inner peripheral surface 605 is formed to extend along a second imaginary cylindrical surface VT2 that is in a form of a cylindrical surface, which is cylindrical about the axis of the housing 20. Here, an inner diameter of the first imaginary cylindrical surface VT1 is substantially equal to an inner diameter of the second imaginary cylindrical surface VT2. More precisely, the inner diameter of the first imaginary cylindrical surface VT1 is slightly smaller than the inner diameter of the second imaginary cylindrical surface VT2. Therefore, the outer peripheral surface 420 of the bearing portion 42, which is opposed to the bearing inner peripheral surface 205, is formed at the location that is substantially the same as the location of the outer peripheral wall of the cam plate 40, which is opposed to the stopper inner peripheral surface 605, in the radial direction of the cam plate 40. In the present embodiment, a difference between the inner diameter of the second imaginary cylindrical surface VT2 and the inner diameter of the first imaginary cylindrical surface VT1 is smaller than a difference between the addendum diameter (the diameter of the addendum parts 32*c*, more specifically the diameter of the addendum circle 32*a*) of the external teeth arrangement 32 and the dedendum diameter (the diameter of the dedendum parts 32*d*, more specifically the diameter of the dedendum circle 32*b*) of the external teeth arrangement 32. The addendum parts 32*c* of the external teeth arrangement 32 substantially coincide with the first imaginary cylindrical surface VT1 at the location that is on the radially inner side of the second imaginary cylindrical surface VT2, and the dedendum parts 32*d* of the external teeth arrangement 32 are placed on the radially inner side of the first imaginary cylindrical surface VT1 and the second imaginary cylindrical surface VT2.

In the present embodiment, an oil passage 13 is formed at the end part of the camshaft 4. When the valve timing adjustment device 1 is installed to the camshaft 4, the oil passage 13 is connected to the annular groove 412 of the cam plate main body 41. A pump 14 is connected to the oil passage 13. The pump 14 suctions the lubricant oil, which is stored in an oil pan (not shown) and supplies the suctioned lubricant oil to the valve timing adjustment device 1. The lubricant oil, which is discharged from the pump 14, is supplied to the inside of the cam plate main body 41 through the oil passage 13, the annular groove 412 and the extension hole portion 411. The lubricant oil, which is supplied to the inside of the cam plate main body 41, flows between the second external teeth arrangement 52 and the second internal teeth arrangement 43 and between the first external teeth arrangement 51 and the first internal teeth arrangement 24 to lubricate these locations. Furthermore, the lubricant oil, which is supplied between the first external teeth arrangement 51 and the first internal teeth arrangement 24, also flows between the stopper inner peripheral surface 605 and the outer peripheral wall of the cam plate 40 and between the bearing inner peripheral surface 205 and the outer peripheral surface 420 of the bearing portion 42. In this way, wearing between the second external teeth arrangement 52 and the second internal teeth arrangement 43, wearing between the first external teeth arrangement 51 and the first internal teeth arrangement 24, and wearing between the bearing inner peripheral surface 205 and the outer peripheral surface 420 of the bearing portion 42 are limited.

Next, the operation of the valve timing adjustment device 1 according to the present embodiment will be described. FIG. 2 shows a state of the valve timing adjustment device 1 at the time of stopping the engine 10 before engine start. Hereinafter, there will be described a case where the cam plate 40 is set at a most retarded angular position relative to the housing 20 during the time of stopping the engine 10.

<Time of Engine Start>

In the state where the engine 10 is stopped, the cam plate 40 is held at the most retarded angular position relative to the housing 20. At this time, the stoppers 60, which are formed at the housing 20, contact the stopper projections 45 of the cam plate 40. When the engine 10 is started, the ECU drives the motor 80 to rotate the input member 70 in a direction (retarding direction) for maintaining the contact between the stoppers 60 and the stopper projections 45.

<After Engine Start>

Immediately after the start of the engine 10, the housing 20 and the cam plate 40 are rotated at the same phase. Therefore, the motor shaft 81 of the motor 80 is rotated at the same phase and the same rotational speed as those of the housing 20 and the cam plate 40.

<Advancing Operation Time>

At the time of executing an advancing control operation of the valve timing adjustment device 1, the ECU controls the rotation of the motor 80 such that the rotational speed of the input member 70 is higher than the rotational speed of the housing 20. Thereby, the gear 50 is rotated and is revolved in the inside of the housing 20, so that the cam plate 40 is rotated in the advancing direction relative to the housing 20. Thus, the rotational phase of the camshaft 4 is advanced, and the opening timing and closing timing of the intake valves 11 are changed to the advancing side.

<Retarding Operation Time>

At the time of executing a retarding control operation of the valve timing adjustment device 1, the ECU controls the rotation of the motor 80 such that the rotational speed of the input member 70 becomes lower than the rotational speed of the housing 20. Thereby, the gear 50 is rotated and is revolved in the inside of the housing 20, so that the cam plate 40 is rotated in the retarding direction relative to the housing 20. Thus, the rotational phase of the camshaft 4 is retarded, and the opening timing and closing timing of the intake valves 11 are changed to the retarding side.

<Intermediate Phase Holding Operation Time>

When the cam plate 40 (the camshaft 4) reaches a target phase, the ECU controls the rotation of the motor 80 such that the rotational speed of the housing 20 becomes equal to the rotational speed of the input member 70. In this way, the gear 50 is not rotated relative to the housing 20, and the cam plate 40 is held at the predetermined phase (the target phase) relative to the housing 20. Therefore, the rotational phase of the camshaft 4 is held at the predetermined phase (the target phase), and the opening timing and closing timing of the intake valves 11 are held at predetermined timings, respectively.

<Engine Stop Time Operation>

When the stop of the engine 10 is commanded during the operation of the valve timing adjustment device 1, the cam plate 40 is rotated in the retarding direction relative to the housing 20 through the operation that is similar to the operation at the retarding operation time, and the rotation of the cam plate 40 is stopped at the most retarded angular position.

Next, a forming method of the external teeth housing 21 and the stopper housing 22 of the housing 20, which is a part of a manufacturing process of the valve timing adjustment device 1 of the present embodiment, will be described with reference to FIG. 4. The external teeth housing 21 and the stopper housing 22 of the housing 20 are formed integrally in one piece by powder metallurgy. The external teeth housing 21 and the stopper housing 22 are formed integrally in one piece through the following steps.

<Punch Placement Step>

First of all, a lower inside punch 101, a lower middle punch 102 and a lower outside punch 103 are placed on a base 100. Here, the lower inside punch 101, the lower middle punch 102 and the lower outside punch 103 are shaped into a substantially cylindrical tubular form. An inner diameter of the lower middle punch 102 is substantially the same as an outer diameter of the lower inside punch 101. An inner diameter of the lower outside punch 103 is substantially the same as an outer diameter of the lower middle punch 102. An axial length of the lower middle punch 102 is longer than an axial length of the lower inside punch 101. An axial length of the lower outside punch 103 is longer than an axial length of the lower middle punch 102. At this step, the lower middle punch 102 is placed on the radially outer side of the lower inside punch 101, and the lower outside punch 103 is placed on the radially outer side of the lower middle punch 102.

<Core Placement Step>

Next, an inside core 120 and an outside core 121 are placed. The inside core 120 is shaped into a substantially cylindrical columnar form. The outside core 121 is shaped into a substantially cylindrical tubular form. An outer diameter of the inside core 120 is substantially the same as an inner diameter of the lower inside punch 101. An inner diameter of the outside core 121 is substantially the same as an outer diameter of the lower outside punch 103. At this step, the inside core 120 is placed on the radially inner side of the lower inside punch 101, and the outside core 121 is placed on the radially outer side of the lower outside punch 103. A space FS, which is shaped into an annular form, is formed between the inside core 120 and the outside core 121 on the opposite side of the lower inside punch 101, the lower middle punch 102 and the lower outside punch 103, which is opposite from the base 100.

<Powder Filling Step>

Next, the metal powder, such as iron powder, is filled in the space FS.

<Compacting Step>

Next, the metal powder, which is filled in the space FS, is compressed by an upper inside punch 111, an upper middle punch 112 and an upper outside punch 113. Here, the upper inside punch 111, the upper middle punch 112 and the upper outside punch 113 are respectively shaped into a substantially cylindrical tubular form. An inner diameter and an outer diameter of the upper inside punch 111 are substantially the same as the inner diameter and the outer diameter of the lower inside punch 101. An inner diameter and an outer diameter of the upper middle punch 112 are substantially the same as the inner diameter and the outer diameter of the lower middle punch 102. An inner diameter and an outer diameter of the upper outside punch 113 are substantially the same as the inner diameter and the outer diameter of the lower outside punch 103. An axial length of the upper outside punch 113 is longer than an axial length of the upper middle punch 112. An axial length of the upper inside punch 111 is longer than an axial length of the upper outside punch 113. At this step, the upper inside punch 111 is placed on the radially outer side of the inside core 120, and the upper middle punch 112 is placed on the radially outer side of the upper inside punch 111. Furthermore, the upper outside punch 113 is placed on the radially outer side of the upper middle punch 112 and on the radially inner side of the outside core 121. In a state where an end surface of the upper inside punch 111, an end surface of the upper middle punch 112 and an end surface of the upper outside punch 113, which are opposite from the base 100, are positioned in a common plane, the upper inside punch 111, the upper middle punch 112 and the upper outside punch 113 are moved toward the base 100. In this way, the metal powder is compressed in the space FS, so that a powder compact PM20 is formed.

<Sintering Step>

Next, the powder compact PM20 is sintered at a high temperature.

<Cutting Step>

Unnecessary portions of the sintered powder compact PM 20 are cut to obtain the external teeth housing 21 and the stopper housing 22, which are integrated in one piece.

As discussed above, in the present embodiment, the external teeth housing 21 and the stopper housing 22 of the housing 20 are formed by a technique known as "near net shape forming", in which the powder compact PM20 shaped in the form that is close to the final product shape is obtained through the powder metallurgy, and thereafter the unnecessary portions are cut. Therefore, the productivity can be improved, and the manufacturing costs can be reduced.

Figure 5:
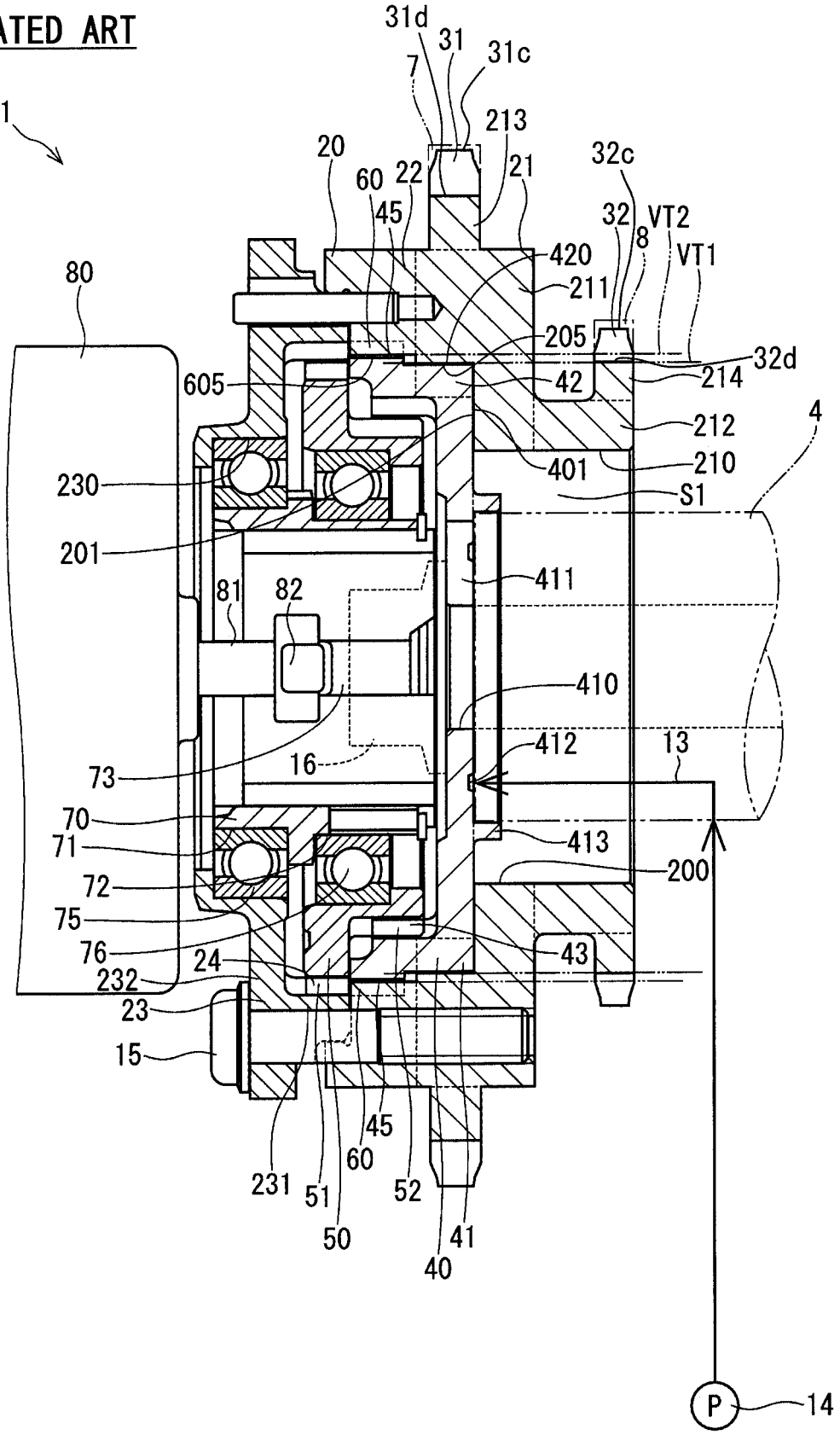
FIG. 5 RELATED ART
FIG. 5 is a cross-sectional view showing a valve timing adjustment device of a first comparative example.
Figure 6:
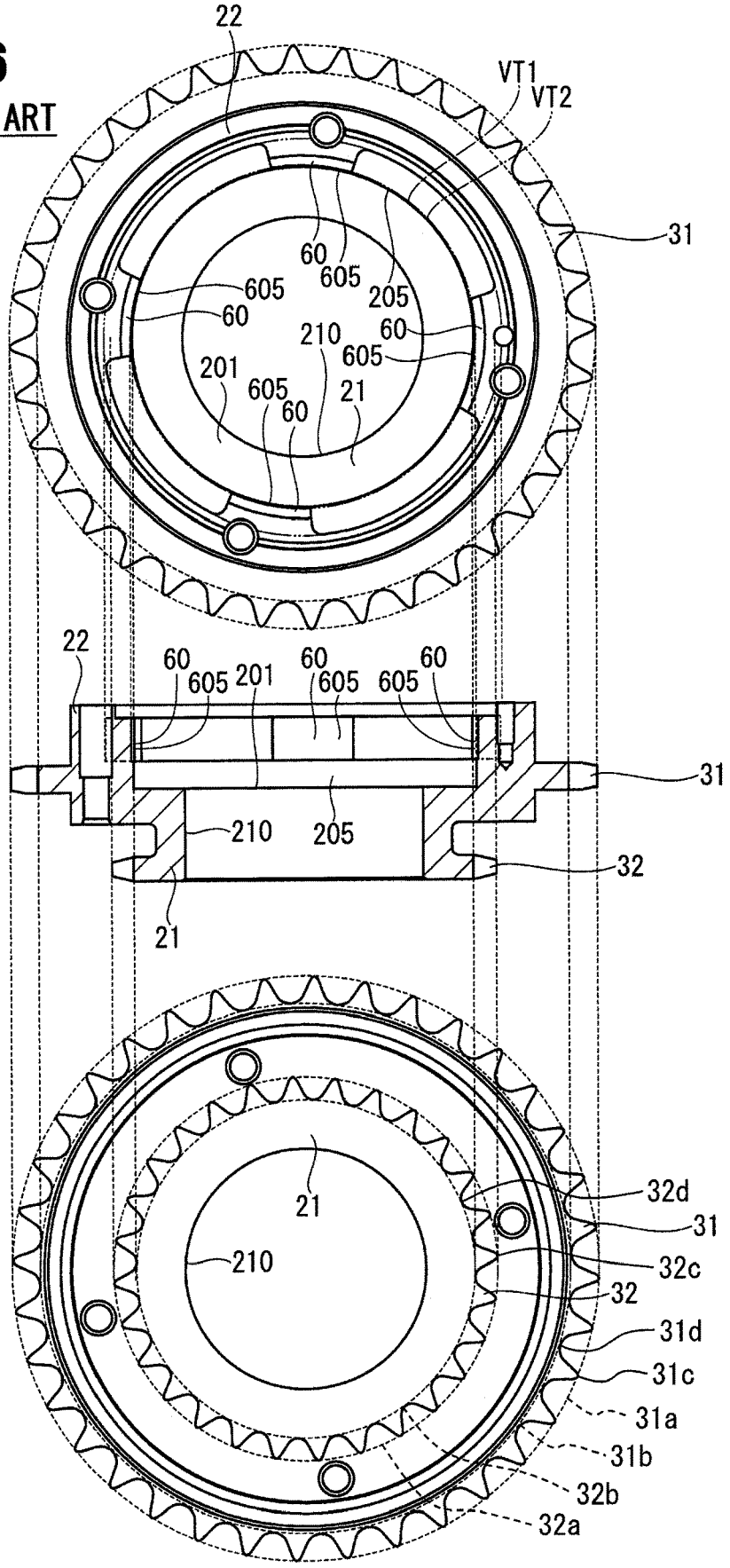
FIG. 6 RELATED ART
FIG. 6 is a diagram indicating a plan view, a cross-sectional view and a bottom view that respectively show a housing of the valve timing adjustment device of the first comparative example.

Next, a first comparative example will be described, and advantages of the present embodiment relative to the first comparative example will be described. FIGS. 5 and 6 show a valve timing adjustment device of the first comparative example and portions thereof. An upper section of FIG. 6 shows the external teeth housing 21 and the stopper housing 22 seen from the cover housing 23 side. A middle section of FIG. 6 shows a cross section of the external teeth housing 21 and the stopper housing 22 taken along a plane that include the axis. A lower section of FIG. 6 shows the external teeth housing 21 and the stopper housing 22 seen from an opposite side that is opposite from the cover housing 23. As shown in FIGS. 5 and 6, in the first comparative example, each of the stoppers 60 is placed at a corresponding position, at which the stopper 60 overlaps with the external teeth arrangement 32 in the view taken in the axial direction of the housing 20.

Figure 7:
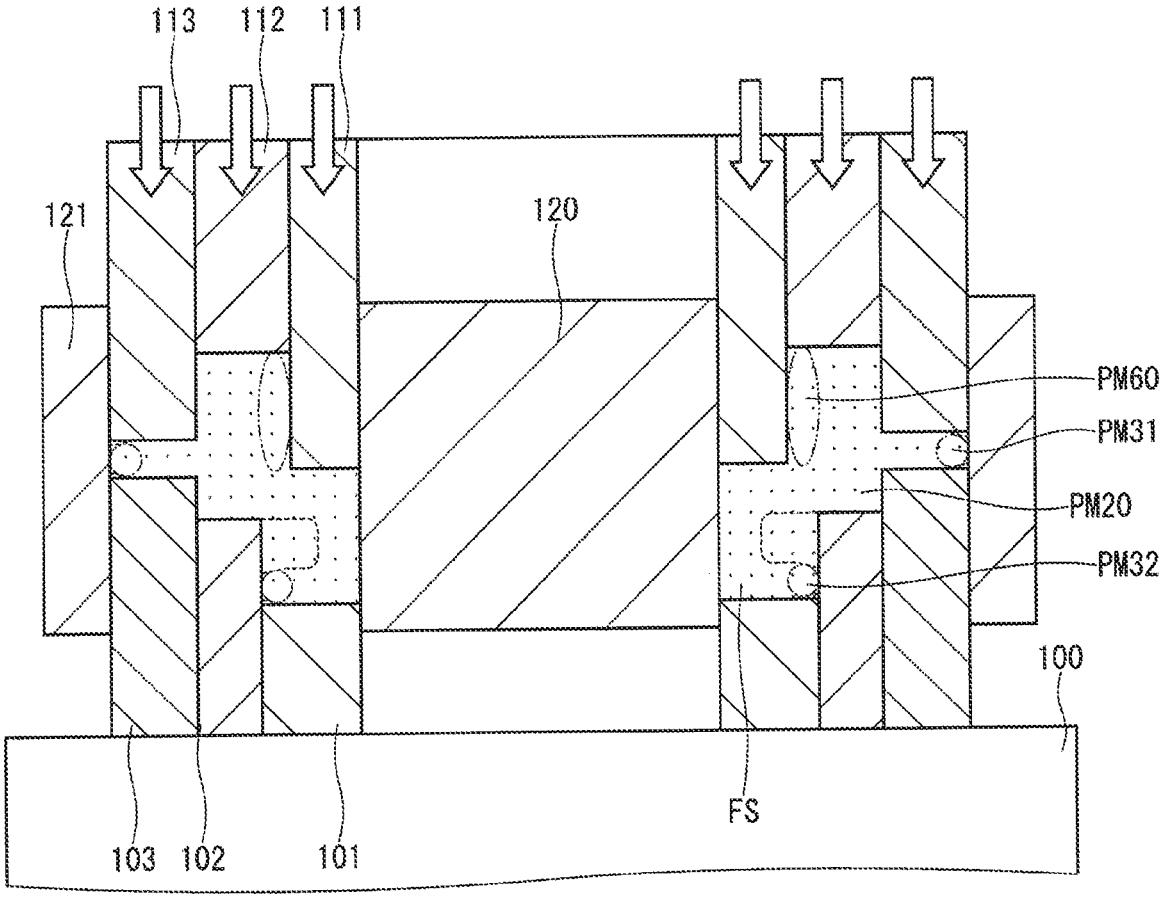
FIG. 7 RELATED ART
FIG. 7 is a diagram for describing a portion of a manufacturing process of the housing of the valve timing adjustment device of the first comparative example.

In the first comparative example, as shown in FIG. 7, the lower inside punch 101, the lower middle punch 102, the lower outside punch 103, the upper inside punch 111, the upper middle punch 112 and the upper outside punch 113, which are used to integrally form the external teeth housing 21 and the stopper housing 22 in one piece, have different shapes that are different from those of the present embodiment. In the first comparative example, an outer diameter of the upper inside punch 111 is smaller than an outer diameter of the lower inside punch 101. An inner diameter of the upper middle punch 112 is smaller than an inner diameter of the lower middle punch 102. Therefore, in a powder compact PM20, a stopper corresponding portion PM60, which is a portion corresponding to the stoppers 60, and an external teeth corresponding portion PM32, which is a portion corresponding to the external teeth arrangement 32, are compressed by the upper middle punch 112, which has an inner peripheral edge part located on an inner side of an outer peripheral edge part of the lower inside punch 101, and the lower inside punch 101, which has an outer peripheral edge part located on an outer side of an inner peripheral edge part of the upper middle punch 112. Specifically, the upper middle punch 112 compresses the stopper corresponding portion PM60, the external teeth corresponding portion PM32 and a portion located on the radially outer side of these portions PM20, PM60 at the powder compact PM20. Here, in the powder compact PM20, an axial length the stopper corresponding portion PM60 and the external teeth corresponding portion PM32 is longer than an axial length of the portion located on the radially outer side of these portions PM60, PM32. Therefore, the amount of compression of the stopper corresponding portion PM60 and the amount of compression of the external teeth corresponding portion PM32 may possibly become insufficient. In this case, a required density of the stopper corresponding portion PM60 and the external teeth corresponding portion PM32 may not be satisfied, and thereby there is a possibility of deteriorating a strength of the stopper 60 and the external teeth arrangement 32 after the sintering.

Figure 4:
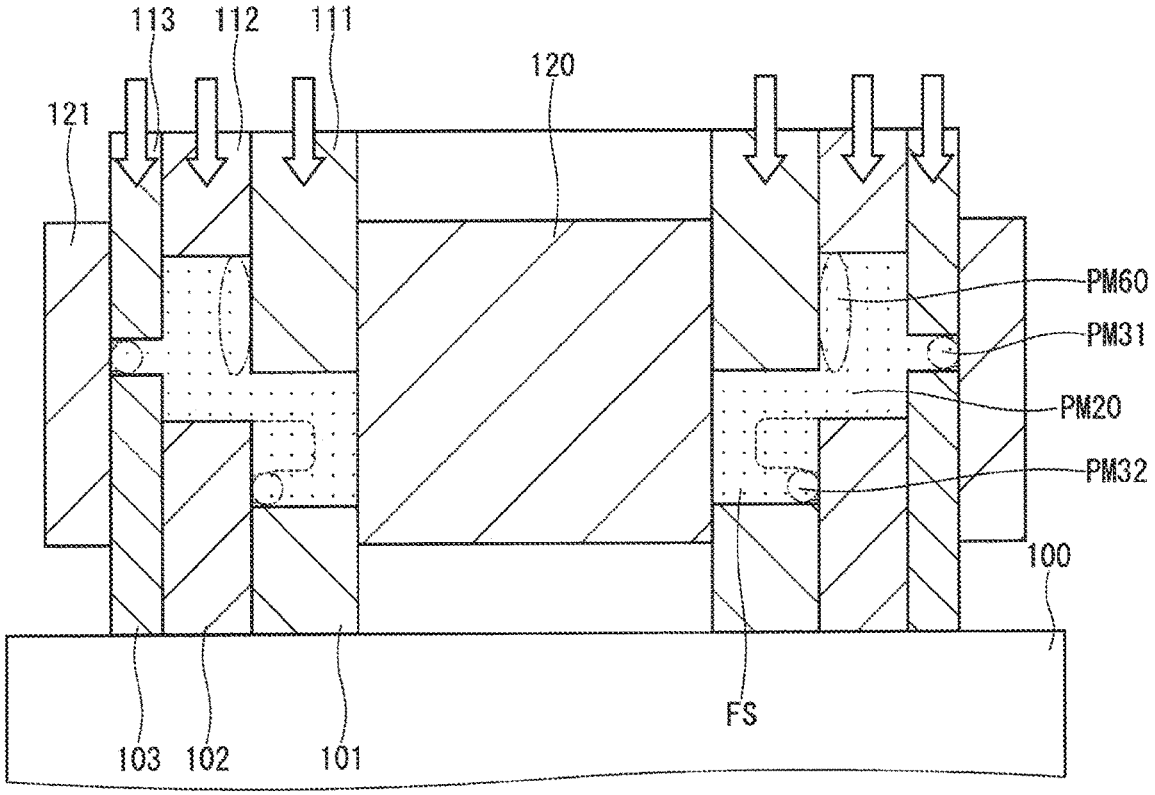
FIG. 4 is a diagram for describing a portion of a manufacturing process of the housing of the valve timing adjustment device according to the first embodiment.

In contrast, in the present embodiment, as shown in FIG. 4, the stopper corresponding portion PM60 of the powder compact PM20 is compressed by the upper middle punch 112 and the lower middle punch 102 while the inner peripheral edge part and the outer peripheral edge part of the upper middle punch 112 coincide with the inner peripheral edge part and the outer peripheral edge part of the lower middle punch 102. Also, the external teeth corresponding portion PM32 of the powder compact PM20 is compressed by the upper inside punch 111 and the lower inside punch 101 while the inner peripheral edge part and the outer peripheral edge part of the upper inside punch 111 coincide with the inner peripheral edge part and the outer peripheral edge part of the lower inside punch 101. Furthermore, the external teeth corresponding portion PM31 of the powder compact PM20 is compressed by the upper outside punch 113 and the lower outside punch 103 while the inner peripheral edge part and the outer peripheral edge part of the upper outside punch 113 coincide with the inner peripheral edge part and the outer peripheral edge part of the lower outside punch 103. Therefore, the stopper corresponding portion PM60, the external teeth corresponding portion PM32 and the external teeth corresponding portion PM31 can be sufficiently compressed. Thus, the stopper corresponding portion PM60, the external teeth corresponding portion PM32 and the external teeth corresponding portion PM31 can satisfy the required density. Therefore, the productivity can be improved while achieving the required strength of the stoppers 60, the external teeth arrangement 32 and the external teeth arrangement 31 after the sintering.

Figure 8:
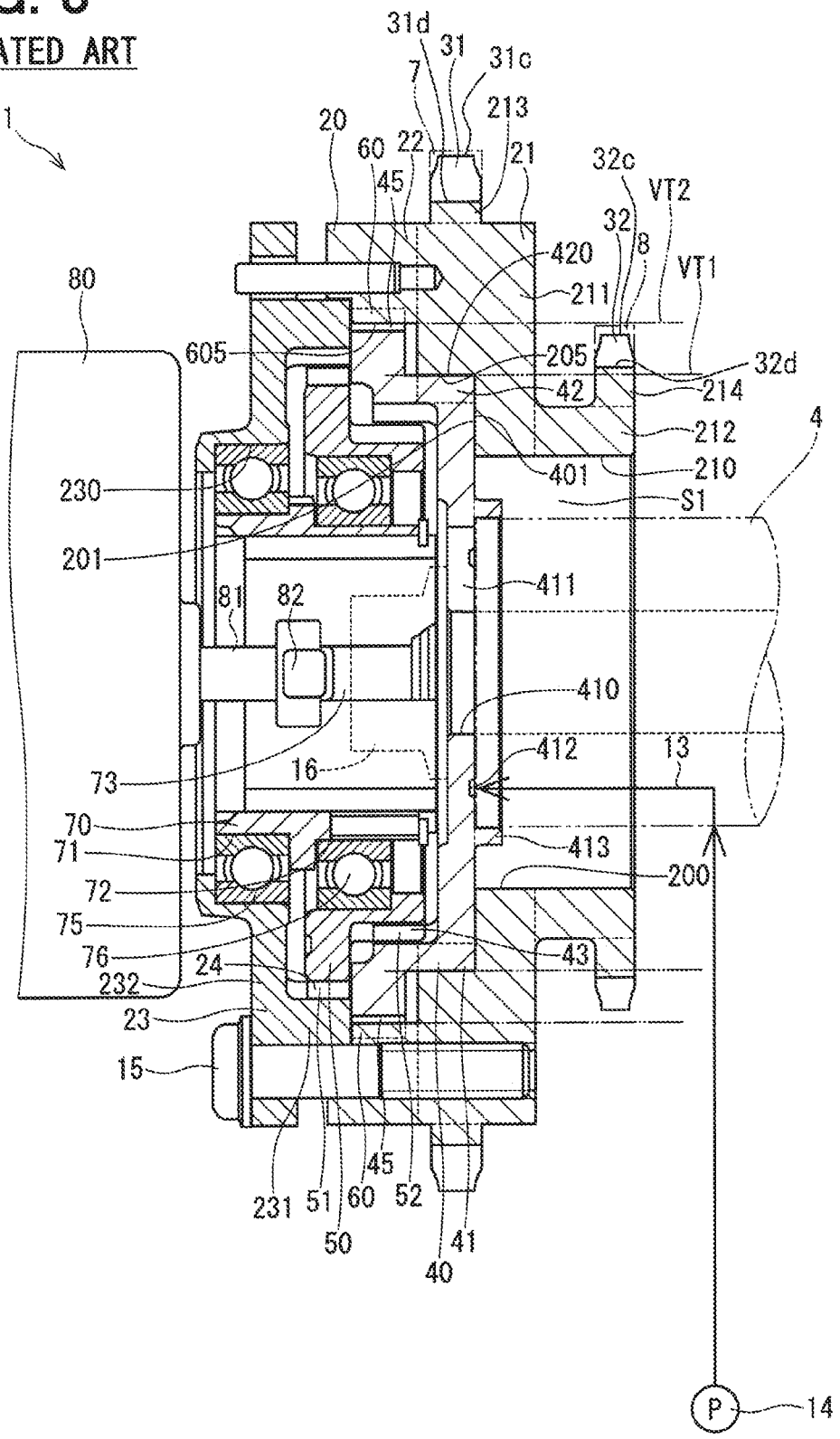
FIG. 8 RELATED ART
FIG. 8 is a cross-sectional view showing a valve timing adjustment device of a second comparative example.

Next, a second comparative example will be described, and advantages of the present embodiment relative to the second comparative example will be described. FIG. 8 shows a valve timing adjustment device of the second comparative example. As shown in FIG. 8, in the second comparative example, an inner diameter of the first imaginary cylindrical surface VT1 is smaller than an inner diameter of the second imaginary cylindrical surface VT2. Therefore, a step, which has a predetermined size, is formed between the bearing inner peripheral surface 205 and the stopper inner peripheral surface 605. Thus, the outer peripheral surface 420 of the bearing portion 42, which is opposed to the bearing inner peripheral surface 205, is formed at a location that is substantially inwardly spaced from the outer peripheral wall of the cam plate 40, which is opposed to the stopper inner peripheral surface 605, in the radial direction of the cam plate 40. The dedendum parts 32*d* and the addendum parts 32*c* of the external teeth arrangement 32 are located on the radially outer side of the first imaginary cylindrical surface VT1 and on the radially inner side of the second imaginary cylindrical surface VT2.

As discussed above, in the second comparative example, the outer peripheral surface 420 of the bearing portion 42, which is opposed to the bearing inner peripheral surface 205, is formed at the location that is substantially inwardly spaced from the outer peripheral wall of the cam plate 40, which is opposed to the stopper inner peripheral surface 605, in the radial direction of the cam plate 40. Therefore, the lubricant oil, which is supplied to the inside of the cam plate main body 41, is accumulated by the centrifugal force at the location between the stopper inner peripheral surface 605 and the outer peripheral wall of the cam plate 40, and thereby the lubricant oil is not likely conducted to the location between the bearing inner peripheral surface 205 and the outer peripheral surface 420 of the bearing portion 42. Thereby, there is a possibility of that the lubricity between the bearing inner peripheral surface 205 and the outer peripheral surface 420 of the bearing portion 42 cannot be ensured.

In contrast, according to the present embodiment, as shown in FIG. 2, the inner diameter of the first imaginary cylindrical surface VT1 is substantially the same as the inner diameter of the second imaginary cylindrical surface VT2. Therefore, the outer peripheral surface 420 of the bearing portion 42, which is opposed to the bearing inner peripheral surface 205, is formed at the location that is substantially the same as the location of the outer peripheral wall of the cam plate 40, which is opposed to the stopper inner peripheral surface 605, in the radial direction of the cam plate 40. Therefore, the lubricant oil, which is supplied to the inside of the cam plate main body 41, can be easily conducted to the location between the bearing inner peripheral surface 205 and the bearing portion 42 by passing through between the stopper inner peripheral surface 605 and the outer peripheral wall of the cam plate 40. Thereby, the lubricity between the bearing inner peripheral surface 205 and the outer peripheral surface 420 of the bearing portion 42 can be sufficiently ensured.

Figure 9:
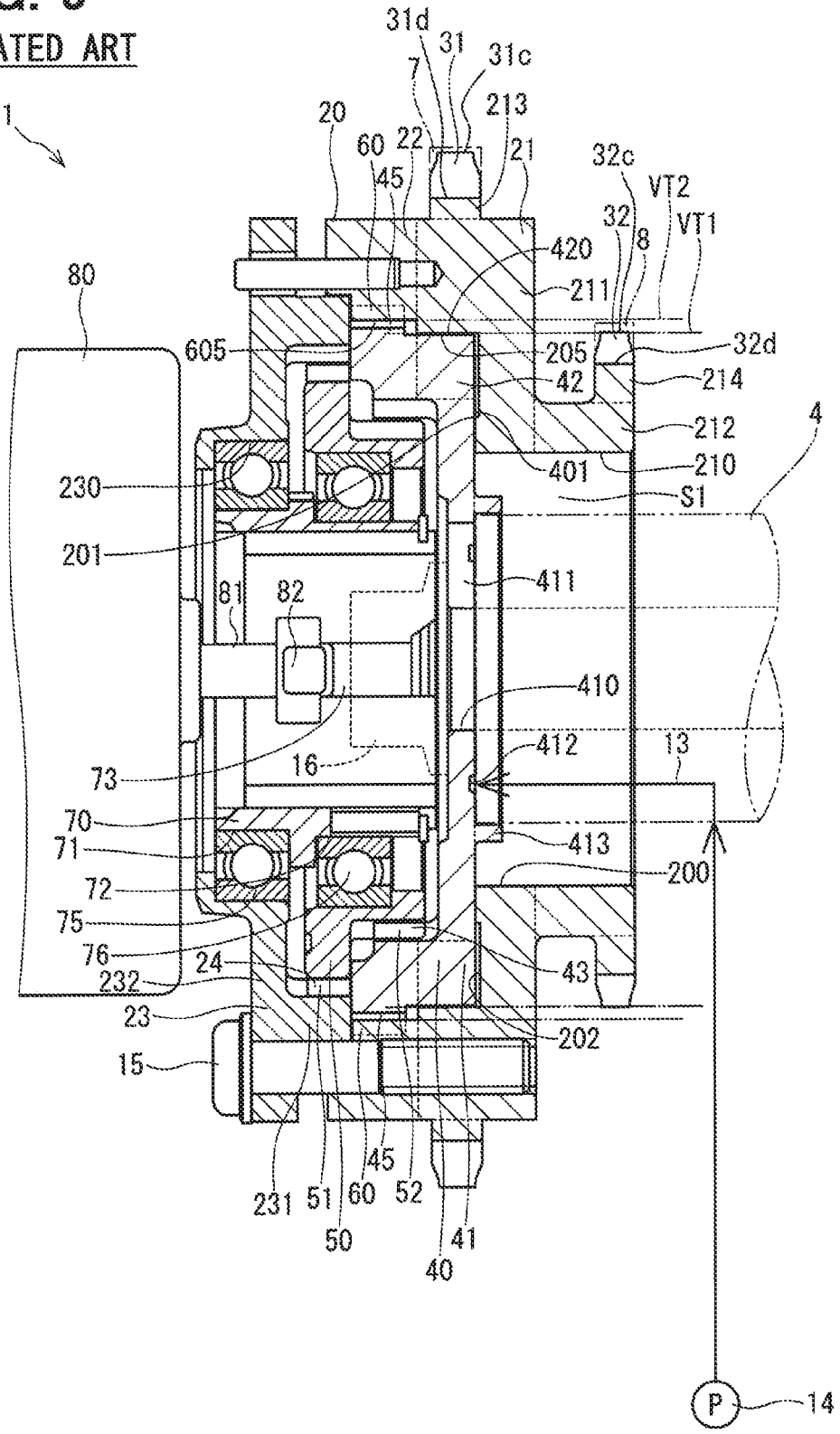
FIG. 9 RELATED ART
FIG. 9 is a cross-sectional view showing a valve timing adjustment device of a third comparative example.

Next, a third comparative example will be described, and advantages of the present embodiment relative to the third comparative example will be described. FIG. 9 shows a valve timing adjustment device of the third comparative example. As shown in FIG. 9, in the third comparative example, an annular recess 202 is formed at the housing plate portion 211. The annular recess 202 is shaped into an annular form and is recessed from an opposite surface of the housing plate portion 211, which is opposite from the housing tubular portion 212, toward the housing tubular portion 212 at the location that is on the radially outer side of the housing hole portion 200. That is, the contactable surface 201 is not in a form of a planar surface. Therefore, there is a possibility of that a foreign object is caught between the annular recess 202 and the wall surface 401 of the cam plate 40 to deteriorate the robustness. Furthermore, since a surface area of the other portion of the contactable surface 201, which is other than the annular recess 202, is relatively small, a surface pressure, which is generated at the contactable surface 201 at the time of contact between the wall surface 401 of the cam plate 40 and the contactable surface 201, may possibly become excessive. Thereby, wearing may occur at the contactable surface 201 and the wall surface 401.

In contrast, according to the present embodiment, as shown in FIG. 2, the annular recess 202 discussed above is not formed at the housing plate portion 211, and the contactable surface 201 is in a form of a planar surface. Therefore, it is possible to limit catching of the foreign object between the contactable surface 201 and the wall surface 401 of the cam plate 40, and thereby it is possible to improve the robustness. Furthermore, since the surface area of the contactable surface 201, which contacts the wall surface 401 of the cam plate 40, is relatively large, the surface pressure, which is generated at the contactable surface 201 at the time of contact between the wall surface 401 of the cam plate 40 and the contactable surface 201, can be reduced. In this way, the wearing of the contactable surface 201 and the wall surface 401 can be limited.

As discussed above, (1) according to the present embodiment, there is provided the valve timing adjustment device 1 that is configured to adjust the valve timing of the intake valves 11 of the engine 10 and includes the housing 20, the plurality of external teeth arrangements 31, 32, the cam plate 40 and the stoppers 60. The housing 20 is rotatable synchronously with the crankshaft 2 of the engine 10. The plurality of external teeth arrangements 31, 32 is respectively shaped into the ring form and is formed integrally with the housing 20 in one piece and is configured to mesh with a plurality of chains 7, 8, respectively, each of which is wound around the crankshaft 2 or the sprocket 6 that is rotatable.

The cam plate 40 is connected to the camshaft 4 of the engine 10 and is rotatable relative to the housing 20. The stoppers 60 are formed integrally with the housing 20 in one piece while the stoppers 60 are configured to limit relative rotation between the housing 20 and the cam plate 40 within the predetermined range when the stoppers 60 contacts the cam plate 40. As discussed above, according to the present embodiment, the housing 20, at which the external teeth arrangement 31 and the external teeth arrangement 32 are formed, and the housing 20, at which the stoppers 60 are formed, are integrally formed in one piece as the one component. Therefore, the number of the components can be reduced to reduce the management costs in comparison to the case where the housing 20 is divided into two parts, more specifically, the external teeth housing 21 and the stopper housing 22 like in the prior art technique disclosed in JP2009-185785A.

It is conceivable that the housing, at which the external teeth arrangements are formed, and the housing, at which the stoppers are formed, are formed integrally in one piece by, for example, powder metallurgy to further improve the productivity. Here, for example, as indicated in the first comparative example, in the case where each of the stoppers 60 is arranged to overlap with the external teeth arrangement 32 in the view taken in the axial direction of the housing 20, the molding die, which molds the stoppers 60, and the molding die, which molds the external teeth arrangement 32, cannot be appropriately separated from each other. Therefore, there is a possibility of that the amount of compression of the metal powder at the corresponding portions of the compact, which respectively correspond to the stoppers 60 and the external teeth arrangement 32, becomes insufficient. In this case, a required density of the corresponding portions of the compact, which respectively correspond to the stoppers 60 and the external teeth arrangement 32, may not be satisfied, and thereby there is a possibility of deteriorating the strength of the stoppers 60 and the external teeth arrangement 32 after the sintering.

In the present embodiment, in view of the above point, each of the stoppers 60 is placed at the corresponding position, at which the stopper 60 does not overlap with any of the external teeth arrangement 31 and the external teeth arrangement 32 in the view taken in the axial direction of the housing 20. Therefore, for example, the molding die used in the powder metallurgy can be divided into the molding die for molding the stoppers and the molding die for molding the external teeth arrangement. Thereby, the metal powder at the corresponding portions of the compact, which correspond to the stoppers 60, the external teeth arrangement 32 and the external teeth arrangement 31, can be sufficiently compressed. In this way, the required density of the corresponding portions of the compact, which correspond to the stoppers 60, the external teeth arrangement 32 and the external teeth arrangement 31, can be satisfied. Therefore, the productivity can be improved while achieving the required strength of the stoppers 60, the external teeth arrangement 32 and the external teeth arrangement 31 after the sintering.

In the valve timing adjustment device of JP2009-185785A, the housing is divided into the two parts, and the one of these two housings is fitted to the other one of these two housings. Thus, a bearing surface of the housing, which rotatably supports the internal member, is radially inwardly deformed, and thereby management of a clearance, which is highly accurately managed to limit generation of the noise, may possibly become difficult. Furthermore, due to generation of distortion that may occur at the time of fitting the one housing to the other housing, the accuracy of female threads, which are threadably engaged with the bolts used for fixing the two housings together, may be deteriorated, and/or the housings may be damaged by the axial force of the bolts. In addition, there is a possibility of deformation of the housings due to torque transmission, and the adjustment accuracy of the valve timing may be deteriorated. Furthermore, since positioning of the two housings is necessary, the number of steps and the number of components may possibly be increased.

In contrast, in the present embodiment, the external teeth housing 21 and the stopper housing 22 are formed integrally in one piece. Therefore, in comparison to the case where the external teeth housing 21 and the stopper housing 22 are formed separately from each other, and one of the external teeth housing 21 and the stopper housing 22 is fitted to the other one of the external teeth housing 21 and the stopper housing 22, it is possible to limit the deformation of the bearing surface (the bearing inner peripheral surface 205) of the housing 20, which rotatably supports the internal member, toward the radially inner side, and thereby the management of the clearance, which is highly accurately managed to limit the generation of the noise, can be eased. Furthermore, since the distortion, which would be generated at the time of fitting the one of the external teeth housing 21 and the stopper housing 22 to the other one of the external teeth housing 21 and the stopper housing 22, is not generated, it is possible to limit the deterioration of the accuracy of the female threads to be threadably engaged with the bolts used for fixing the corresponding portions of the housing 20 and/or to limit the damage of the housing 20 caused by the axial force of the bolts. Further, there is no concern about deformation of the housing 20 caused by the torque transmission, and thereby the required adjustment accuracy of the valve timing can be maintained. Furthermore, since it is not required to position the external teeth housing 21 and the stopper housing 22 relative to each other, it is possible to reduce the number of the steps and the components.

Furthermore, (2) according to the present embodiment, there is further provided the gear 50. The gear 50 is configured to mesh with the housing 20 and the cam plate 40. Furthermore, the gear 50 is configured to be rotated by the motor 80 to make relative rotation between the housing 20 and the cam plate 40. Therefore, in comparison to the valve timing adjustment device, in which the housing and the cam plate are rotatable relative to each other by the oil pressure, control of the opening and closing of the intake valves 11 can be finely executed in a wide range.

Furthermore, (3) in the present embodiment, in the view taken in the axial direction of the housing 20, the stoppers 60 are placed on the radially outer side of the addendum parts 32*c* of the external teeth arrangement 32 that is the radially innermost one among the plurality of external teeth arrangements 31, 32. Therefore, the inner diameter of the stoppers 60 can be increased. Thereby, the size of the space in the inside of the stoppers 60 at the housing 20 can be increased, and thereby it is possible to give a margin with respect to the packaging of the internal components, such as the gear 50, in the housing 20. Therefore, the adjustment of the gear reduction ratio at the gear 50 is eased.

Furthermore, (4) in the present embodiment, the cam plate 40 includes the bearing portion 42 that has the outer peripheral surface 420 configured to receive the load, which is applied from the inner peripheral surface of the housing 20 in the radially inward direction. In a case where the number of the bearing locations is two in the axial direction of the housing 20, when the inner diameter of the stoppers 60 is increased, the bearing diameter in the radial direction is increased. Thus, when the cam plate 40 is tilted relative to the housing 20, the bearing portion 42 may possibly pry the housing 20 in the greater amount even at the same amount of tilt of the cam plate 40. In the present embodiment, the bearing location for receiving the load in the radial direction of the housing 20 is only one location, i.e., the bearing portion 42 in the axial direction of the housing 20. Therefore, the inner diameter of the stoppers 60 can be increased while the prying of the bearing portion 42 is limited. In addition, since the length of the moment arm is increased by the enlargement of the inner diameter of the stoppers 60, the impact torque, which is generated at the time of abutting the stopper projections 45 against the stoppers 60, can be reduced. Thereby, strength robustness can be improved.

Furthermore, (5) according to the present embodiment, in the state where the camshaft 4 and the cam plate 40 are connected with each other, the gap S1 is formed between the camshaft 4 and the housing 20 to limit application of the load from the housing 20 to the camshaft 4 in the radially inward direction. In this way, the bearing location for receiving the load in the radial direction of the housing can be only the one location, i.e., the bearing portion 42 in the axial direction of the housing 20. Thus, as discussed above, the inner diameter of the stoppers 60 can be increased while the prying of the bearing portion 42 is limited. Furthermore, even in a case where the cam plate 40 and the camshaft 4 are connected with each other in a state where an axis of the cam plate 40 and an axis of the camshaft 4 are deviated from each other, the prying of the cam plate 40 against the housing 20 can be limited. In this way, it is possible to limit disablement of the relative rotation between the housing 20 and the cam plate 40. Thus, it is possible to maintain the smooth relative rotation between the housing 20 and the cam plate 40.

Furthermore, (6) according to the present embodiment, the housing 20 includes the bearing inner peripheral surface 205. The bearing inner peripheral surface 205 is opposed to the outer peripheral surface 420 of the bearing portion 42 and extends along the first imaginary cylindrical surface VT1 that is cylindrical about the axis of the housing 20. Each stopper 60 includes the stopper inner peripheral surface 605. The stopper inner peripheral surface 605 is opposed to the outer peripheral surface of the cam plate 40 and extends along the second imaginary cylindrical surface VT2 that is cylindrical about the axis of the housing 20. The inner diameter of the first imaginary cylindrical surface VT1 is substantially equal to the inner diameter of the second imaginary cylindrical surface VT2. Therefore, in response to the increase in the inner diameter of the stoppers 60, i.e., the inner diameter of the stopper inner peripheral surfaces 605 (the second imaginary cylindrical surface VT2), the inner diameter of the bearing inner peripheral surfaces 205 (the first imaginary cylindrical surface VT1) is increased to be equal to the inner diameter of the stopper inner peripheral surfaces 605 (second imaginary cylindrical surface VT2). Thereby, the lubricity of the bearing portion 42 is ensured.

Furthermore, (7) according to the present embodiment, the housing 20 includes the contactable surface 201 that forms the inner wall of the housing 20, which is contactable with the wall surface 401 at the one of the two opposite axial sides of the cam plate 40. The contactable surface 201 is formed as the planar surface. Therefore, it is possible to limit catching of the foreign object between the contactable surface 201 and the wall surface 401 of the cam plate 40, and thereby it is possible to improve the robustness. Furthermore, since the surface area of the contactable surface 201, which contacts the wall surface 401 of the cam plate 40, is relatively large, the surface pressure, which is generated at the contactable surface 201 at the time of contact between the wall surface 401 of the cam plate 40 and the contactable surface 201, can be reduced. In this way, the wearing of the contactable surface 201 and the wall surface 401 can be limited.

Furthermore, (8) according to the present embodiment, in the view taken in the axial direction of the housing 20, the stoppers 60 are located on the radially outer side of the addendum parts 32*c* of the external teeth arrangement 32 that is the radially innermost one among the plurality of external teeth arrangements 31, 32, and the stoppers 60 are located on the radially inner side of the dedendum parts 31*d* of the external teeth arrangement 31 that is the radially outermost one among the plurality of external teeth arrangements 31, 32. Therefore, the size of the housing 20 in the radial direction can be reduced while the inner diameter of the stoppers 60 is increased.

Second Embodiment

Figure 10:
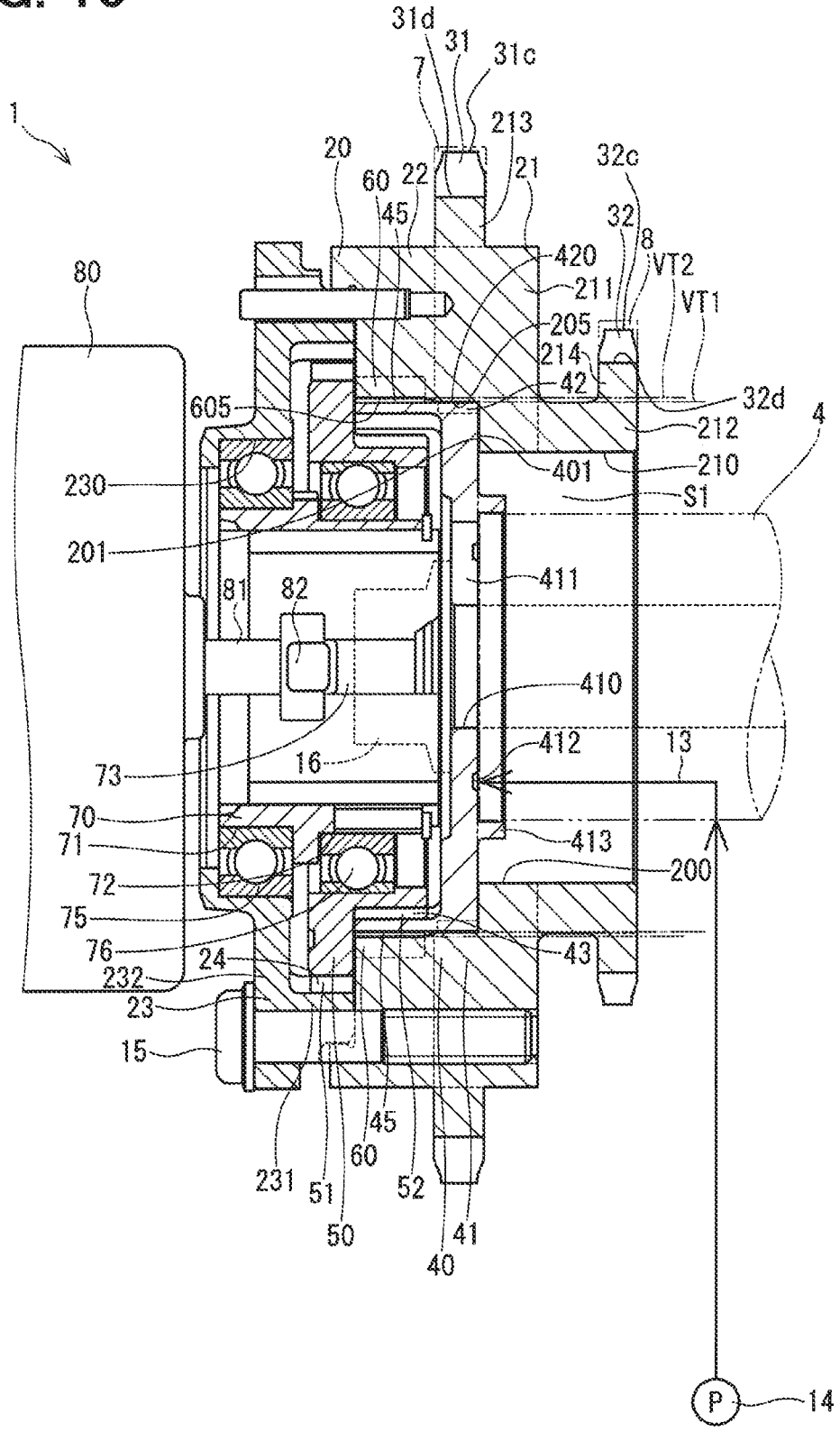
FIG. 10 is a cross-sectional view showing a valve timing adjustment device according to a second embodiment.
Figure 11:
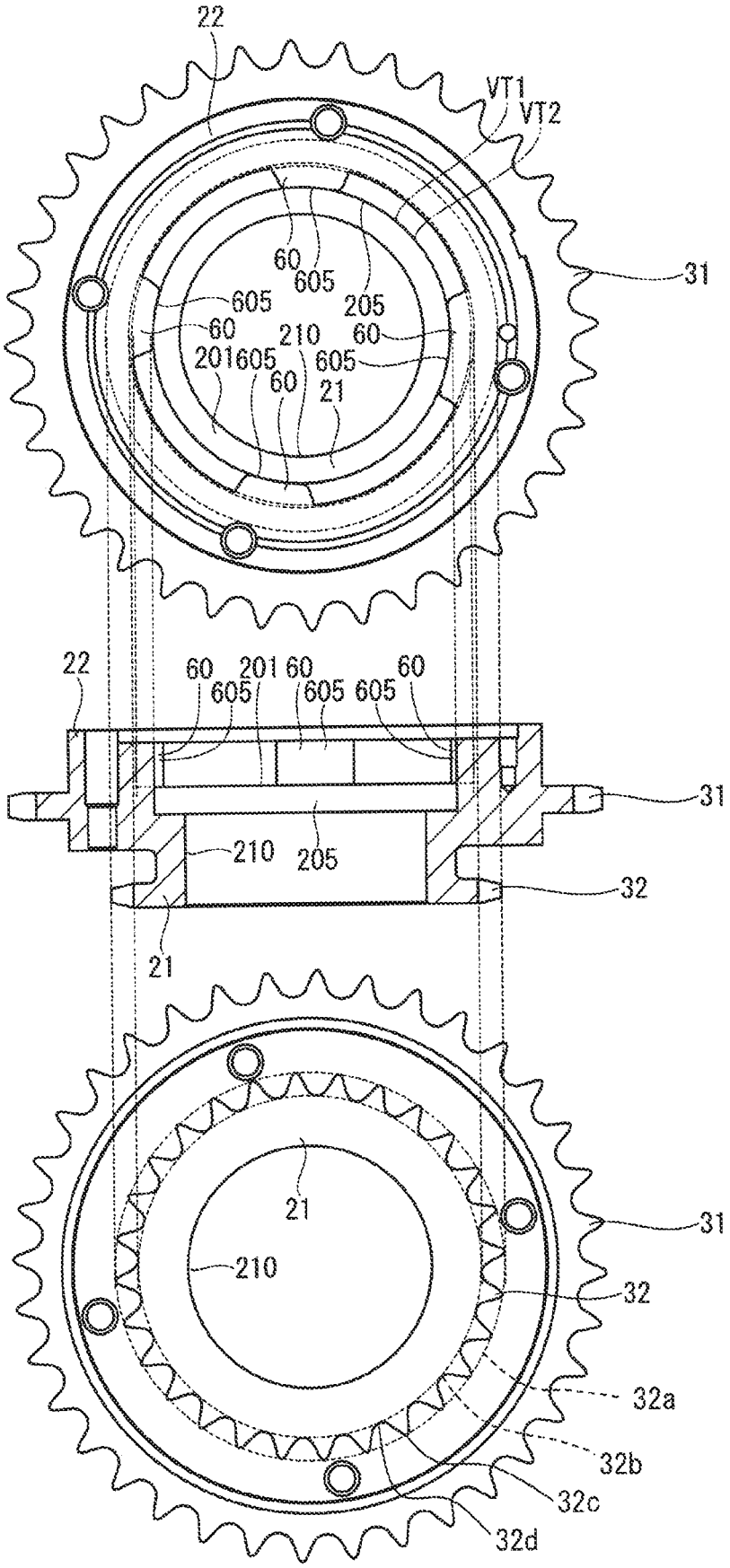
FIG. 11 is a diagram indicating a plan view, a cross-sectional view and a bottom view that respectively show a housing of the valve timing adjustment device according to the second embodiment.

FIGS. 10 and 11 show a valve timing adjustment device of a second embodiment and portions thereof. An upper section of FIG. 11 shows the external teeth housing 21 and the stopper housing 22 seen from the cover housing 23 side. A middle section of FIG. 11 shows a cross section of the external teeth housing 21 and the stopper housing 22 taken along a plane that include the axis. A lower section of FIG. 11 shows the external teeth housing 21 and the stopper housing 22 seen from an opposite side that is opposite from the cover housing 23. The second embodiment differs from the first embodiment with respect to the structure of the housing 20.

As shown in FIGS. 10 and 11, in the present embodiment, each of the stoppers 60 is placed at the corresponding position, at which the stopper 60 does not overlap with any of the external teeth arrangement 31 and the external teeth arrangement 32 in a view taken in the axial direction of the housing 20. Furthermore, in the view taken in the axial direction of the housing 20, the stoppers 60 are placed on the radially inner side of the dedendum parts 32*d* of the external teeth arrangement 32 that is the radially innermost one among the two external teeth arrangements 31, 32. The addendum parts 32*c* and the dedendum parts 32*d* of the external teeth arrangement 32 are located on the radially outer side of the first imaginary cylindrical surface VT1 and the second imaginary cylindrical surface VT2.

As discussed above, (1) in the present embodiment, each of the stoppers 60 is placed at the corresponding position, at which the stopper 60 does not overlap with any of the external teeth arrangement 31 and the external teeth arrangement 32 in the view taken in the axial direction of the housing 20. Therefore, similar to the first embodiment, the productivity can be improved while achieving the required strength of the stoppers 60, the external teeth arrangement 32 and the external teeth arrangement 31 after the sintering.

Furthermore, (9) according to the present embodiment, in the view taken in the axial direction of the housing 20, the stoppers 60 are placed on the radially inner side of the dedendum parts 32*d* of the external teeth arrangement 32 that is the radially innermost one among the plurality of external teeth arrangements 31, 32. Therefore, the sizes of the internal components of the housing 20 in the radial direction can be reduced.

Third Embodiment

Figure 12:
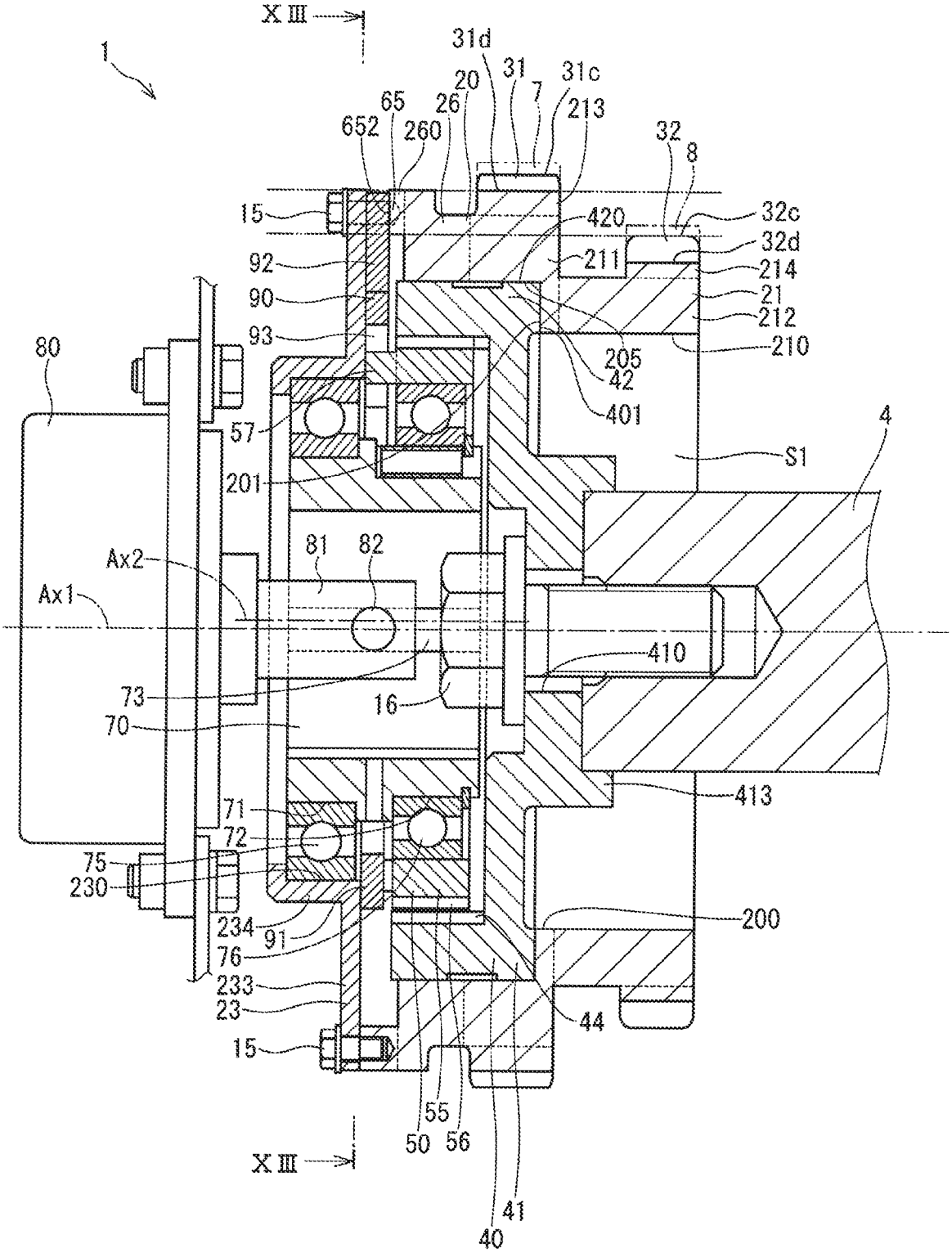
FIG. 12 is a cross-sectional view showing a valve timing adjustment device according to a third embodiment.
Figure 13:
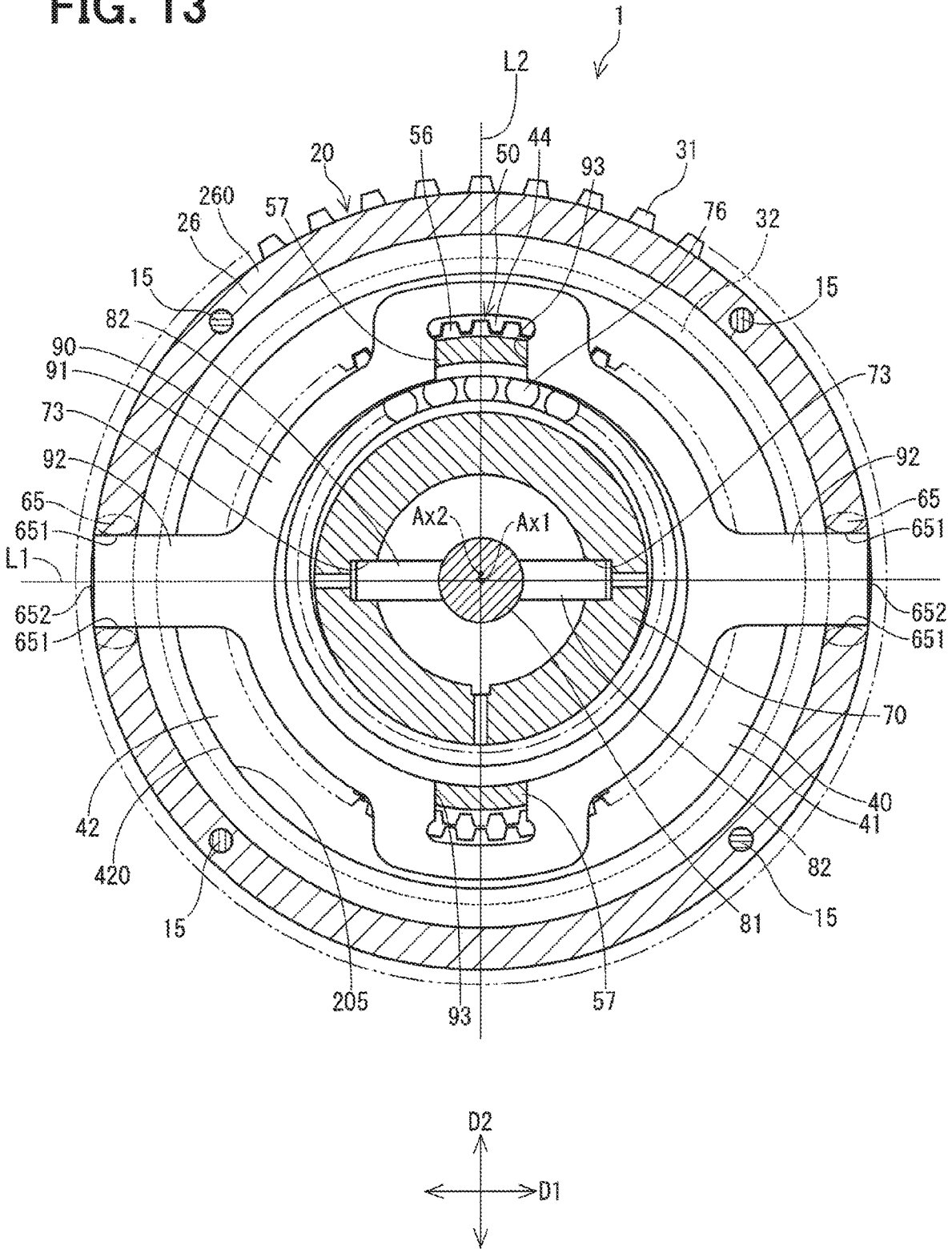
FIG. 13 is a cross-sectional view taken along line XIII-XIII in FIG. 12.

FIGS. 12 and 13 show a valve timing adjustment device according to a third embodiment. The third embodiment differs from the first embodiment with respect to the internal structure of the valve timing adjustment device 1.

As shown in FIGS. 12 and 13, in the third embodiment, the valve timing adjustment device 1 includes the housing 20, the external teeth arrangement 31, the external teeth arrangement 32, the cam plate 40, the gear 50, an Oldham coupling 90, a plurality of engaging portions 65 and the input member 70.

The housing 20 includes the external teeth housing 21, an engaging portion housing 26 and the cover housing 23. The external teeth housing 21, the engaging portion housing 26 and the cover housing 23 are made of, for example, metal. In the present embodiment, the external teeth housing 21 and the engaging portion housing 26 are formed integrally in one piece. The cover housing 23 is formed separately from the external teeth housing 21 and the engaging portion housing 26. The external teeth housing 21 and the engaging portion housing 26 are formed integrally in one piece by, for example, powder metallurgy.

The external teeth housing 21 includes the housing plate portion 211, the housing tubular portion 212, the housing ring portion 213 and the housing ring portion 214. The housing plate portion 211 is shaped into a substantially circular plate form. The housing hole portion 200 extends through a center of the housing plate portion 211 in a plate thickness direction of the housing plate portion 211. An inner peripheral surface of the housing hole portion 200 is in a form of a substantially cylindrical surface.

The housing tubular portion 212 is formed integrally with the housing plate portion 211 in one piece such that the housing tubular portion 212 is in a tubular form and extends from an outer peripheral edge part of the housing hole portion 200 at a surface of the housing plate portion 211, which is located on one axial side. The inner peripheral surface of the housing tubular portion 212 is in a form of a substantially cylindrical surface. An inner diameter of the housing hole portion 200 and an inner diameter of the housing tubular portion 212 are equal to each other. Thereby, the inner peripheral surface 210, which is in a form of a substantially cylindrical surface, is formed at an inside of the housing hole portion 200 and the housing tubular portion 212.

The housing ring portion 213 is formed integrally with the housing plate portion 211 in one piece such that the housing ring portion 213 is in a ring form and extends in a radially outward direction from an outer peripheral surface of the housing plate portion 211. The housing ring portion 214 is formed integrally with the housing tubular portion 212 in one piece such that the housing ring portion 214 is in a ring form and extends in the radially outward direction from an outer peripheral surface of an opposite end part of the housing tubular portion 212, which is opposite from the housing plate portion 211.

The engaging portion housing 26 is formed integrally with the housing plate portion 211 in one piece such that the engaging portion housing 26 is in a ring form and is located on an opposite side of the housing plate portion 211, which is opposite from the housing tubular portion 212. The engaging portion housing 26 includes a ring portion 260, which is shaped into a substantially circular ring form and is located at an end part of the engaging portion housing 26, which is opposite from the housing plate portion 211. The ring portion 260 is coaxial with the housing tubular portion 212.

The cover housing 23 includes a cover plate portion 233 and a cover tubular portion 234. The cover plate portion 233 is in a substantially circular plate form. The cover tubular portion 234 is formed integrally with the cover plate portion 233 in one piece such that the cover tubular portion 234 is in a substantially cylindrical tubular form and extends from a center of the cover plate portion 233. The cover housing 23 includes a cover hole portion 230 that penetrates through the center of the cover plate portion 233 and extends along an inner peripheral surface of the cover tubular portion 234. The cover housing 23 is formed such that an outer peripheral edge part of an opposite end surface of the cover plate portion 233, which is opposite from the cover tubular portion 234, is joined to an opposite end part of the engaging portion housing 26, which is opposite from the external teeth housing 21. The cover housing 23 is coaxial with the engaging portion housing 26. The cover housing 23, the engaging portion housing 26 and the external teeth housing 21 are integrated together by the bolts 15.

The external teeth arrangement 31 is formed integrally with the external teeth housing 21 in one piece such that the external teeth arrangement 31 is in a ring form and is placed on a radially outer side of the housing ring portion 213. The external teeth arrangement 31 includes a plurality of external teeth, which are arranged one after the other in the circumferential direction (see FIG. 13). Similar to the first embodiment, the chain 7, which is wound around the crankshaft 2, is wound around the external teeth arrangement 31. The external teeth arrangement 31 is configured to mesh with the chain 7. Thereby, when the crankshaft 2 is rotated, the drive force is transmitted to the housing 20 through the chain 7. Thus, the housing 20 is rotated synchronously with the crankshaft 2.

The external teeth arrangement 32 is formed integrally with the external teeth housing 21 in one piece such that the external teeth arrangement 32 is in a ring form and is placed on a radially outer side of the housing ring portion 214. The external teeth arrangement 32 includes a plurality of external teeth, which are arranged one after the other in the circumferential direction. Similar to the first embodiment, the chain 8, which is wound around the sprocket 6, is wound around the external teeth arrangement 32. The external teeth arrangement 32 is configured to mesh with the chain 8. Thereby, when the crankshaft 2 is rotated, the drive force is transmitted from the crankshaft 2 to the sprocket 6 through the chain 7, the external teeth arrangement 31, the external teeth arrangement 32 and the chain 8. Thus, the camshaft 5 is rotated synchronously with the crankshaft 2.

The external teeth arrangement 31 and the external teeth arrangement 32 are coaxial with each other. The dedendum diameter and the addendum diameter of the external teeth arrangement 31 are set to be larger than the dedendum diameter and the addendum diameter of the external teeth arrangement 32. The external teeth arrangement 31 and the external teeth arrangement 32 are arranged one after the other and are spaced by a predetermined gap in the axial direction of the housing 20. Specifically, in the present embodiment, the number of the external teeth arrangements 31, 32 is two. The external teeth arrangement 31 and the external teeth arrangement 32 are processed through quenching treatment and thereby have increased hardness.

The cam plate 40 includes the cam plate main body 41. The cam plate main body 41 is shaped into a bottomed tubular form. A tubular portion of the cam plate main body 41 is shaped into a substantially cylindrical tubular form. A plate hole portion 410 extends through a center of a bottom portion of the cam plate main body 41 in a plate thickness direction of the bottom portion of the cam plate main body 41. Furthermore, a plate tubular portion 413 is formed at the bottom portion of the cam plate main body 41 as follows. Specifically, the plate tubular portion 413 is in a substantially cylindrical tubular form and extends from an end surface of the bottom portion of the cam plate main body 41, which is opposite from the tubular portion of the cam plate main body 41. The plate tubular portion 413 is formed to be coaxial with the tubular portion of the cam plate main body 41 and the plate hole portion 410.

The cam plate 40 is placed at the inside of the housing 20 such that the plate tubular portion 413 is placed on the inner side of the inner peripheral surface 210 of the housing 20, and the cam plate main body 41 is placed on the inner side of the engaging portion housing 26. Here, the outer diameter of the plate tubular portion 413 is set to be smaller than the inner diameter of the inner peripheral surface 210.

The cam plate 40 is connected to the camshaft 4 such that an end part of the camshaft 4 is fitted into the inside of the plate tubular portion 413. The cam plate 40 and the camshaft 4 are fixed together by the bolt 16 such that relative rotation between the cam plate 40 and the camshaft 4 is prevented. In this way, the cam plate 40 is rotated integrally with the camshaft 4. The cam plate 40 is rotatable relative to the housing 20. In the state where the cam plate 40 is connected to the camshaft 4, a gap, which is shaped into a substantially cylindrical form, is formed between an outer peripheral surface of the camshaft 4 and the inner peripheral surface 210 of the housing 20. Therefore, a load, which is radially inwardly exerted from the housing 20, is not directly applied to the outer peripheral surface of the camshaft 4.

In the present embodiment, a bearing portion 42 is formed at a portion of the cam plate main body 41. The bearing portion 42 is formed at the tubular portion of the cam plate main body 41. The outer peripheral surface 420 of the bearing portion 42 receives the load, which is radially inwardly exerted from the inner peripheral surface of the housing plate portion 211 and the inner peripheral surface of the engaging portion housing 26 of the housing 20. Specifically, the bearing portion 42 rotatably supports the housing 20 through the outer peripheral surface 420. The outer peripheral surface 420 of the bearing portion 42 is in a form of a substantially cylindrical surface. A bearing inner peripheral surface 205, which is an inner peripheral surface of the housing 20 opposed to the outer peripheral surface 420, is shaped in a form of a substantially cylindrical surface. When the cam plate 40 and the housing 20 are rotated relative to each other, the outer peripheral surface 420 of the bearing portion 42 and the bearing inner peripheral surface 205 of the housing 20 slid relative to each other. An axial part of the bearing inner peripheral surface 205 and an axial part of the outer peripheral surface 420 of the bearing portion 42 are placed on the radially inner side of the external teeth arrangement 31. Therefore, when the load is radially inwardly applied from the chain 7 to the housing 20 through the external teeth arrangement 31, this radially inwardly applied load can be received by the bearing portion 42 of the cam plate 40.

An internal teeth arrangement 44, which is shaped into a ring form, is formed at an inner peripheral wall of the tubular portion of the cam plate main body 41. The internal teeth arrangement 44 includes a plurality of internal teeth, which are arranged one after the other in the circumferential direction.

The gear 50 is made of, for example, metal. The gear 50 include a gear main body 55, an external teeth arrangement 56 and a plurality of gear engaging portions 57. The gear main body 55 is shaped into a substantially cylindrical tubular form. The external teeth arrangement 56 is shaped into a ring form and is formed at an outer peripheral wall of the gear main body 55.

The gear 50 is placed at the inside of the housing 20 such that the external teeth arrangement 56 is meshed with the internal teeth arrangement 44 of the cam plate 40. Specifically, the gear 50 is placed on the cover housing 23 side of the cam plate main body 41. Here, the dedendum diameter and the addendum diameter of the external teeth arrangement 56 are set to be smaller than the dedendum diameter and the addendum diameter of the internal teeth arrangement 44. The number of teeth of the external teeth arrangement 56 is smaller than the number of teeth of the internal teeth arrangement 44 by one.

The gear engaging portions 57 are formed integrally with the gear main body 55 such that the gear engaging portions 57 extend from the cover housing 23 side end surface of the gear main body 55 toward the cover housing 23. The number of the gear engaging portions 57 is two, and these two gear engaging portions 57 are arranged one after the other at equal intervals in the circumferential direction of the gear main body 55 (see FIG. 13).

The Oldham coupling 90 is made of, for example, metal. The Oldham coupling 90 includes an Oldham main body 91, a plurality of Oldham engaging portions 92 and a plurality of Oldham engaging grooves 93. The Oldham main body 91 is formed in a substantially annular plate form. The Oldham engaging portions 92 are formed integrally with the Oldham main body 91 in one piece such that each of the Oldham engaging portions 92 outwardly extends from an outer peripheral edge part of the Oldham main body 91 in the radial direction. The number of the Oldham engaging portions 92 is two, and these Oldham engaging portions 92 are arranged at equal intervals in the circumferential direction of the Oldham main body 91 (see FIG. 13).

Each of the Oldham engaging grooves 93 is formed to radially outwardly outward extend from an inner peripheral edge part of the Oldham main body 91. The number of the Oldham engaging grooves 93 is two, and these Oldham engaging grooves 93 are arranged at equal intervals in the circumferential direction of the Oldham main body 91 (see FIG. 13). A straight line L1, which connects between centers of the two Oldham engaging portions 92, is perpendicular to a straight line L2, which connects between centers of the two Oldham engaging grooves 93.

A width of each of the Oldham engaging grooves 93 measured in the circumferential direction of the Oldham main body 91 is set to be slightly larger than a width of the corresponding gear engaging portion 57 measured in the circumferential direction of the gear main body 55. The Oldham coupling 90 is formed such that the two gear engaging portions 57 are engaged with the two Oldham engaging grooves 93, respectively. Therefore, the two gear engaging portions 57 are located along the straight line L2. The Oldham coupling 90 is movable relative to the gear 50 in the radial direction of the gear main body 55, i.e., in a direction D2 along the straight line L2 (see FIG. 13). When the Oldham coupling 90 is moved relative to the gear 50 in the direction D2, the gear engaging portions 57 are slid relative to the Oldham engaging grooves 93. Furthermore, the relative rotation between each of the gear engaging portions 57 and the corresponding one of the Oldham engaging grooves 93 is limited through engagement between each of the gear engaging portions 57 and the corresponding one of the Oldham engaging grooves 93.

The engaging portions 65 are formed integrally with the ring portion 260 of the engaging portion housing 26 in one piece. Each of the engaging portions 65 is formed in a form of a groove such that at an end part of the ring portion 260, which is opposite from the housing tubular portion 212, each of the engaging portions 65 extends through the ring portion 260 in the radial direction, i.e., communicates between an inner peripheral wall and an outer peripheral wall of the ring portion 260. The number of the engaging portions 65 is two, and these engaging portions 65 are arranged at equal intervals in the circumferential direction of the ring portion 260 (see FIG. 13).

A width of each of the engaging portions 65 measured in the direction D2, i.e., a distance between two parallel side surfaces of the engaging portion 65 in the form of groove is set to be slightly larger than a width of the corresponding one of the Oldham engaging portions 92 measured in the direction D2, i.e., a distance between two parallel side surfaces of the Oldham engaging portion 92. The Oldham coupling 90 is formed such that the Oldham engaging portions 92 are engaged with the engaging portions 65, respectively. The Oldham coupling 90 is movable relative to the engaging portion housing 26 in the radial direction of the ring portion 260, i.e., in a direction D1 along the straight line L1 (see FIG. 13). When the Oldham coupling 90 is moved relative to the engaging portion housing 26 in the direction D1, the Oldham engaging portions 92 are slid along the engaging portions 65, respectively. Furthermore, the relative rotation between the engaging portion housing 26 and the Oldham coupling 90 is limited through the engagement between each of the Oldham engaging portions 92 and the corresponding one of the engaging portions 65.

Each of the engaging portions 65 includes engaging/sliding surfaces 651, 652. The engaging/sliding surfaces 651 are respectively formed at the side surfaces of the engaging portion 65 that is in the form of the groove such that the engaging/sliding surfaces 651 are engageable and are slidable relative to the side surfaces of the corresponding Oldham engaging portion 92. The number of the engaging/sliding surfaces 651 of each engaging portion 65 is two, and these engaging/sliding surfaces 651 are parallel to each other. The engaging/sliding surface 652 is formed at a bottom surface of the engaging portion 65 that is in the form of the groove such that the engaging/sliding surface 652 is engageable and is slidable relative to an opposite surface of the Oldham engaging portion 92, which is opposite from the cover housing 23.

The Oldham coupling 90 limits the relative rotation between the gear 50 and the housing 20 through the engagement between each of the Oldham engaging grooves 93 and the corresponding one of the gear engaging portions 57 and the engagement between each of the Oldham engaging portions 92 and the corresponding one of the engaging portions 65. Therefore, at the time of driving the engine 10, the force, which results from a change in the cam torque generated at the camshaft 4, may possibly be applied from the Oldham engaging portions 92 to the engaging portions 65.

The input member 70 is shaped into a tubular form and is made of, for example, metal. The input member 70 includes a first cylindrical surface 71 and a second cylindrical surface 72. The first cylindrical surface 71 and the second cylindrical surface 72 are respectively shaped into a form of a substantially cylindrical surface and are formed at an outer peripheral wall of the input member 70 such that the first cylindrical surface 71 and the second cylindrical surface 72 are arranged one after the other in the axial direction of the input member 70. The first cylindrical surface 71 is formed to be coaxial with an inner peripheral surface of the input member 70. The second cylindrical surface 72 is eccentric to the inner peripheral surface and the first cylindrical surface 71 of the input member 70. As shown in FIGS. 12 and 13, a central axis Ax1 of the input member 70 coincides with an axis of an inner peripheral surface of the input member 70 and an axis of the first cylindrical surface 71 of the input member 70, and an eccentric axis Ax2 coincides with an axis of the second cylindrical surface 72 of the input member 70 and an axis of the gear 50. Furthermore, the central axis Ax1 coincides with the axis of the housing 20 and the axis of the cam plate 40.

The input member 70 is placed at the inside of the housing 20 such that the first cylindrical surface 71 is placed at an inside of the cover hole portion 230 of the cover housing 23, and the second cylindrical surface 72 is placed at the inside of the gear 50. The first bearing 75 is placed between the first cylindrical surface 71 and the cover hole portion 230. The second bearing 76 is placed between the second cylindrical surface 72 and the inner peripheral wall of the gear 50.

With this configuration, when the input member 70 is rotated relative to the housing 20 and the cam plate 40, the eccentric axis Ax2 of the input member 70 is revolved around the central axis Ax1. In response to the revolution of the eccentric axis Ax2, an engaging location of the external teeth arrangement 56 of the gear 50 relative to the internal teeth arrangement 44 of the cam plate 40 is changed in the circumferential direction of the internal teeth arrangement 44, and the gear 50 tries to rotate about the eccentric axis Ax2.

As discussed above, at the time of revolving the eccentric axis Ax2 of the input member 70 about the central axis Ax1, the displacement of the gear 50 is transmitted from the gear engaging portions 57 to the Oldham engaging grooves 93. In a case where the displacement of the gear 50 exerts a force component in the direction D1, the Oldham coupling 90 is displaced relative to the housing 20 in the direction D1. Furthermore, in a case where the displacement of the gear 50 exerts a force component in the direction D2, the gear 50 is displaced relative to the Oldham coupling 90 in the direction D2.

The number of the teeth of the external teeth arrangement 56 of the gear 50 is set to be smaller than the number of teeth of the internal teeth arrangement 44 of the cam plate 40 by one. Therefore, when the eccentric axis Ax2 of the input member 70 is revolved to make one full revolution about the center axis Ax1, the cam plate 40 is rotated by the amount, which corresponds to the one tooth, and thereby the rotational speed of the rotation inputted to the input member 70 is reduced.

In the present embodiment, the relative rotation between the gear 50 and the housing 20 is limited by the Oldham coupling 90. Therefore, the cam plate 40 is rotated about the central axis Ax1 by a rotational force that is exerted to rotate the gear 50 in response to the revolution of the gear 50. Specifically, when the gear 50 is revolved relative to the cam plate 40, the cam plate 40 is rotated relative to the housing 20. At this time, the Oldham coupling 90 and the gear 50 are moved relative to the housing 20 in the direction D1, and the gear 50 is moved relative to the Oldham coupling 90 and the housing 20 in the direction D2.

The joint grooves 73, which extend in the axial direction, are formed at the inner peripheral wall of the input member 70. The motor 80 is installed to the engine 10 such that the joints 82 are engaged with the joint grooves 73, respectively. Therefore, when the motor 80 is rotated by supplying the electric power to the motor 80, the input member 70 is rotated. When the input member 70 is rotated, the gear 50 is rotated and is revolved relative to the cam plate 40. In this way, the Oldham coupling 90 is moved relative to the housing 20, and the housing 20 and the cam plate 40 are rotated relative to each other. As discussed above, the Oldham coupling 90 is movable relative to the housing 20. When the rotation is inputted from the outside to the input member 70 of the valve timing adjustment device 1, the Oldham coupling 90 is moved relative to the housing 20, and thereby the housing 20 and the cam plate 40 can be rotated relative to each other.

As shown in FIGS. 12 and 13, according to the present embodiment, in the view taken in the axial direction of the housing 20, the ring portion 260 of the engaging portion housing 26 is arranged to be placed between the external teeth arrangement 31 and the external teeth arrangement 32. Therefore, in the view taken in the axial direction of the housing 20, each of the engaging portions 65 is placed at the position where the engaging portion 65 does not overlap with the external teeth arrangement 31 and the external teeth arrangement 32. Here, in the view taken in the axial direction of the housing 20, the engaging portions 65 are placed on the radially outer side of the addendum parts 32*c* of the external teeth arrangement 32 that is the radially innermost one among the two external teeth arrangements 31, 32, and the engaging portions 65 are also placed on the radially inner side of the dedendum parts 31*d* of the external teeth arrangement 31 that is the radially outermost one among the two external teeth arrangements 31, 32. Furthermore, the external teeth arrangement 31 and the external teeth arrangement 32 are formed at corresponding locations, respectively, at which the external teeth arrangement 31 and the external teeth arrangement 32 do not overlap with each other in the view taken in the axial direction of the housing 20.

As discussed above, (10) according to the present embodiment, there is provided the valve timing adjustment device 1 that is configured to adjust the valve timing of the intake valves 11 of the engine 10 and includes the housing 20, the plurality of external teeth arrangements 31, 32, the cam plate 40 and the Oldham coupling 90. The housing 20 is rotatable synchronously with the crankshaft 2 of the engine 10. The plurality of external teeth arrangements 31, 32 is respectively shaped into the ring form and is formed integrally with the housing 20 in one piece and is configured to mesh with a plurality of chains 7, 8, respectively, each of which is wound around the crankshaft 2 or the sprocket 6 that is rotatable.

The cam plate 40 is connected to the camshaft 4 of the engine 10 and is rotatable relative to the housing 20. The Oldham coupling 90 is configured to implement the relative rotation between the housing 20 and the cam plate 40 through the movement of the Oldham coupling 90 relative to the housing 20 when the rotation is inputted to the Oldham coupling 90 from the outside. The engaging portions 65 are formed integrally with the housing 20 in one piece, and the engaging portions 65 are engageable and are slidable relative to the Oldham coupling 90. As discussed above, according to the present embodiment, the housing 20, at which the external teeth arrangement 31 and the external teeth arrangement 32 are formed, and the housing 20, at which the engaging portions 65 are formed, are integrally formed in one piece as the one component. Therefore, the number of the components can be reduced to reduce the management costs in comparison to the case where the manufacturing takes place while the housing 20 is divided into the two parts, i.e., the external teeth housing 21 and the engaging portion housing 26.

In the present embodiment, each of the engaging portions 65 is placed at the position, at which the engaging portion 65 does not overlap with any of the external teeth arrangement 31 and the external teeth arrangement 32 in the view taken in the axial direction of the housing 20. Therefore, for example, the molding die used in the powder metallurgy can be divided into the molding die for molding the engaging portions and the molding die for molding the external teeth arrangement. Thereby, the metal powder at the corresponding portions of the compact, which correspond to the engaging portions 65, the external teeth arrangement 32 and the external teeth arrangement 31, can be sufficiently compressed. In this way, the required density of the corresponding portions of the compact, which correspond to the engaging portions 65, the external teeth arrangement 31 and the external teeth arrangement 32, can be satisfied. Therefore, the productivity can be improved while achieving the required strength of the engaging portions 65, the external teeth arrangement 31 and the external teeth arrangement 32 of the housing 20 after the sintering.

Furthermore, according to the present embodiment, since the strength of each of the engaging portions 65 is high, wearing of the engaging portion 65 through the engagement and the slide movement of the engaging portion 65 relative to the Oldham coupling 90 can be limited.

Furthermore, (11) according to the present embodiment, in the view taken in the axial direction of the housing 20, the engaging portions 65 are placed on the radially outer side of the addendum parts 32*c* of the external teeth arrangement 32 that is the radially innermost one among the plurality of external teeth arrangements 31, 32, and the engaging portions 65 are placed on the radially inner side of the dedendum parts 31*d* of the external teeth arrangement 31 that is the radially outermost one among the plurality of external teeth arrangements 31, 32. Therefore, it is possible to limit an increase in the size of the housing 20 while the required volume of the space is ensured at the inside of the housing 20. Thereby, the valve timing adjustment device 1 can be made compact while giving a margin with respect to the size and the packaging of the internal components, such as the gear 50 and the cam plate 40, in the housing 20.

Fourth Embodiment

Figure 14:
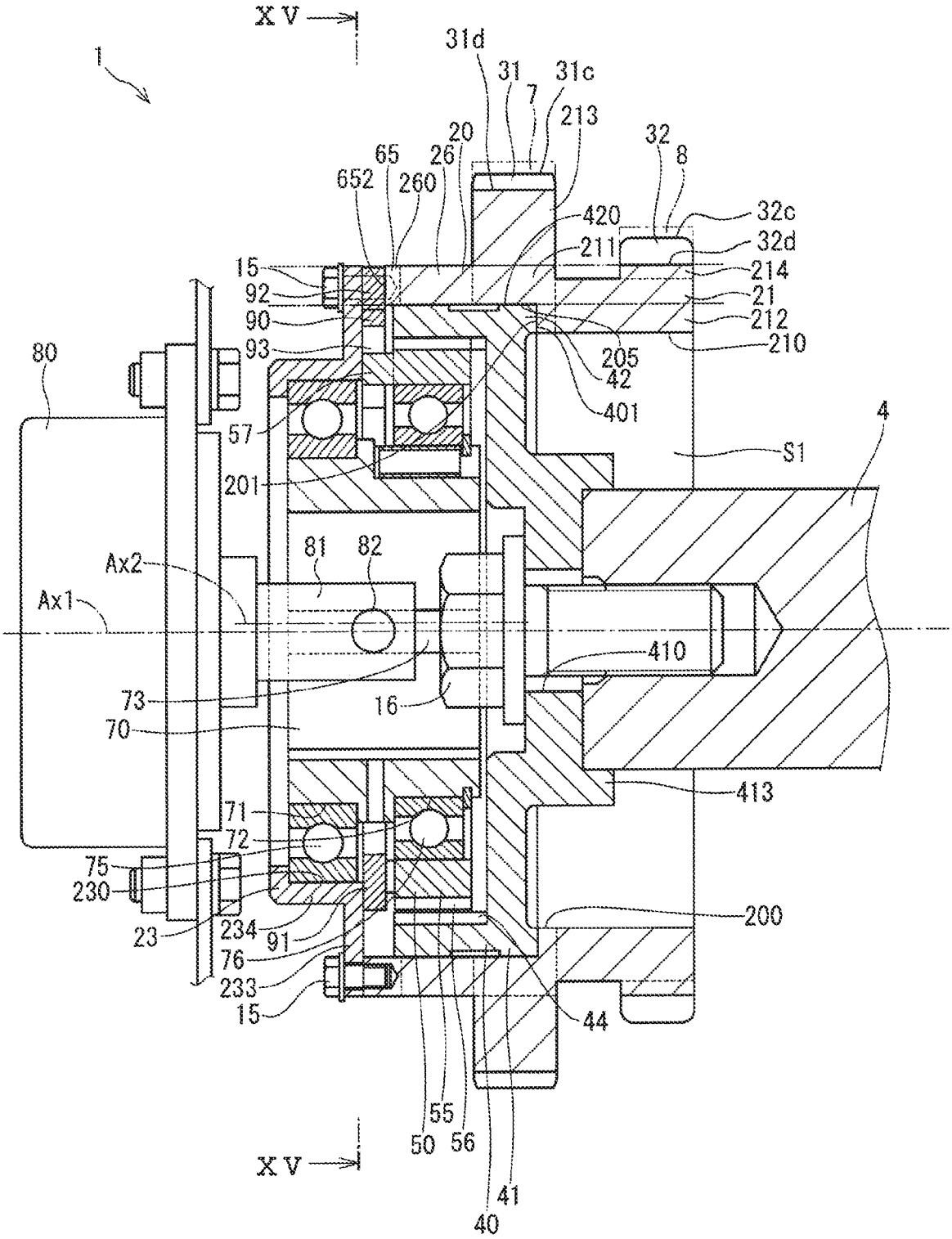
FIG. 14 is a cross-sectional view showing a valve timing adjustment device according to a fourth embodiment.
Figure 15:
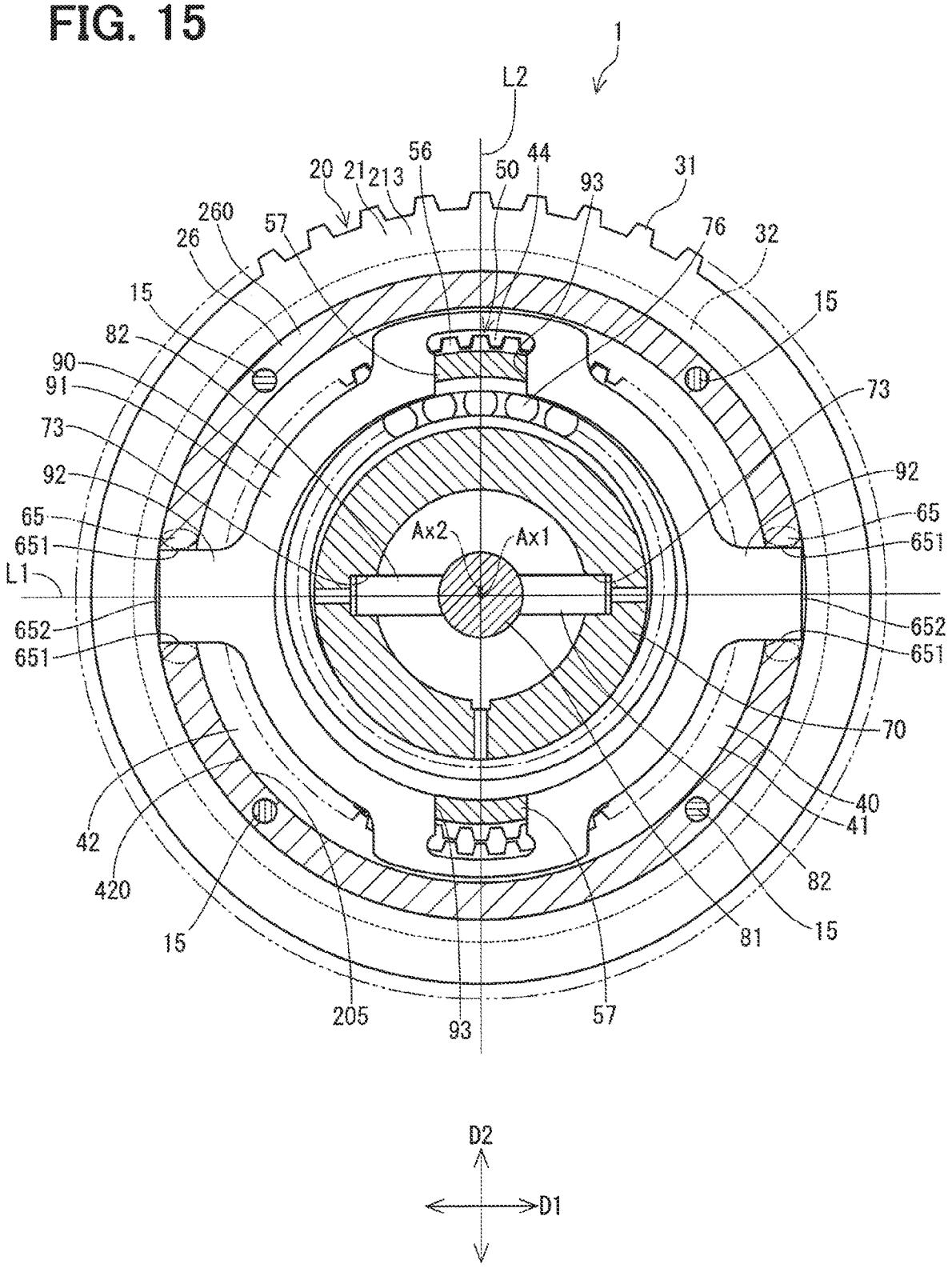
FIG. 15 is a cross-sectional view taken along line XV-XV in FIG. 14.

FIGS. 14 and 15 show a valve timing adjustment device according to a fourth embodiment. The fourth embodiment differs from the third embodiment with respect to the location of the engaging portions 65.

As shown in FIGS. 14 and 15, according to the present embodiment, in the view taken in the axial direction of the housing 20, the ring portion 260 of the engaging portion housing 26 is arranged to be placed on the radially inner side of the external teeth arrangement 32. Therefore, in the view taken in the axial direction of the housing 20, each of the engaging portions 65 is placed at the position where the engaging portion 65 does not overlap with the external teeth arrangement 31 and the external teeth arrangement 32. Furthermore, in the view taken in the axial direction of the housing 20, the engaging portions 65 are placed on the radially inner side of the dedendum part 32*d* of the external teeth arrangement 32 that is the radially innermost one among the two external teeth arrangements 31, 32.

As discussed above, (12) according to the present embodiment, in the view taken in the axial direction of the housing 20, the engaging portions 65 are placed on the radially inner side of the dedendum parts 32*d* of the external teeth arrangement 32 that is the radially innermost one among the plurality of external teeth arrangements 31, 32. Therefore, it is possible to limit an increase in the size of the housing 20, and the valve timing adjustment device 1 can be made compact.

Fifth Embodiment

Figure 16:
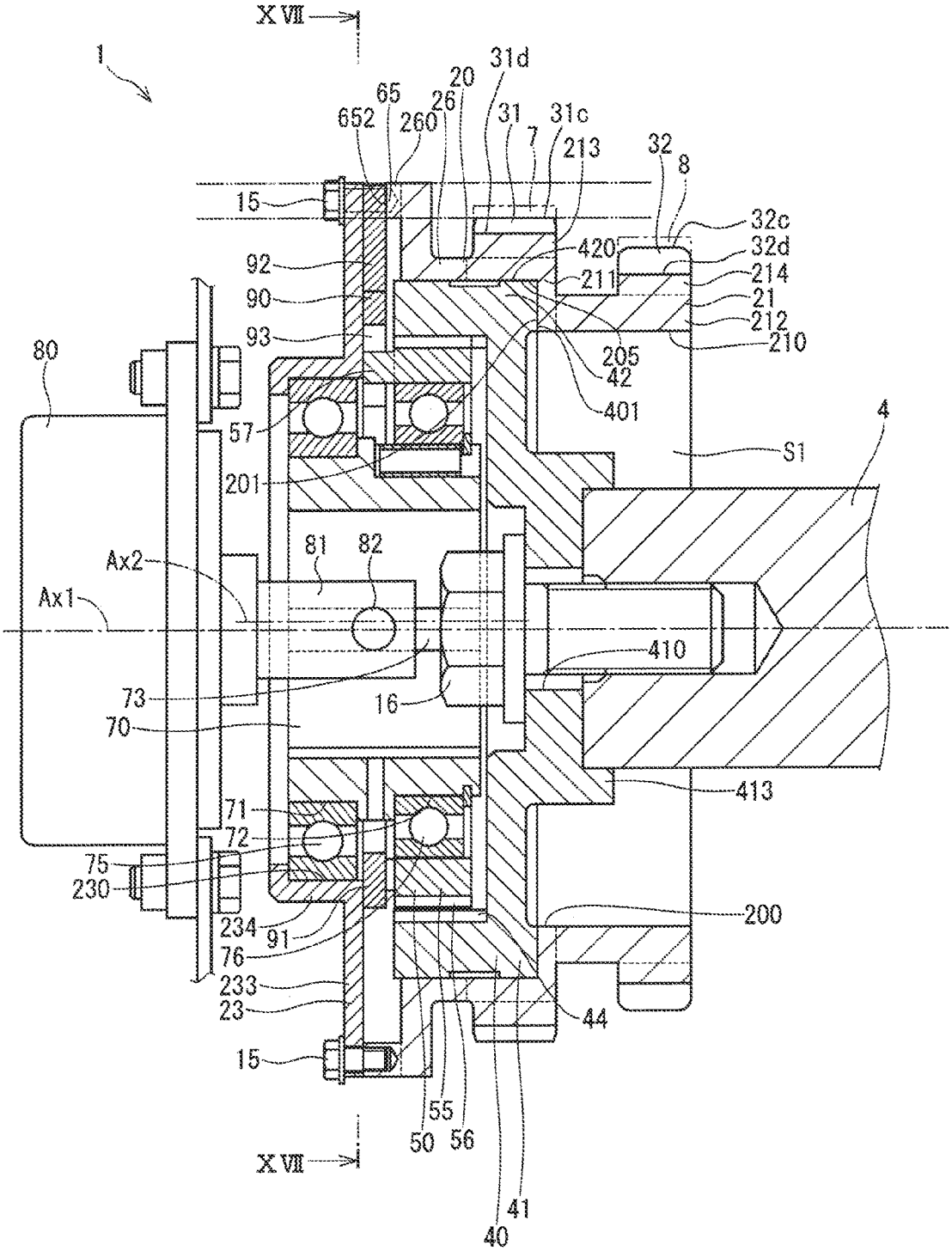
FIG. 16 is a cross-sectional view showing a valve timing adjustment device according to a fifth embodiment.
Figure 17:
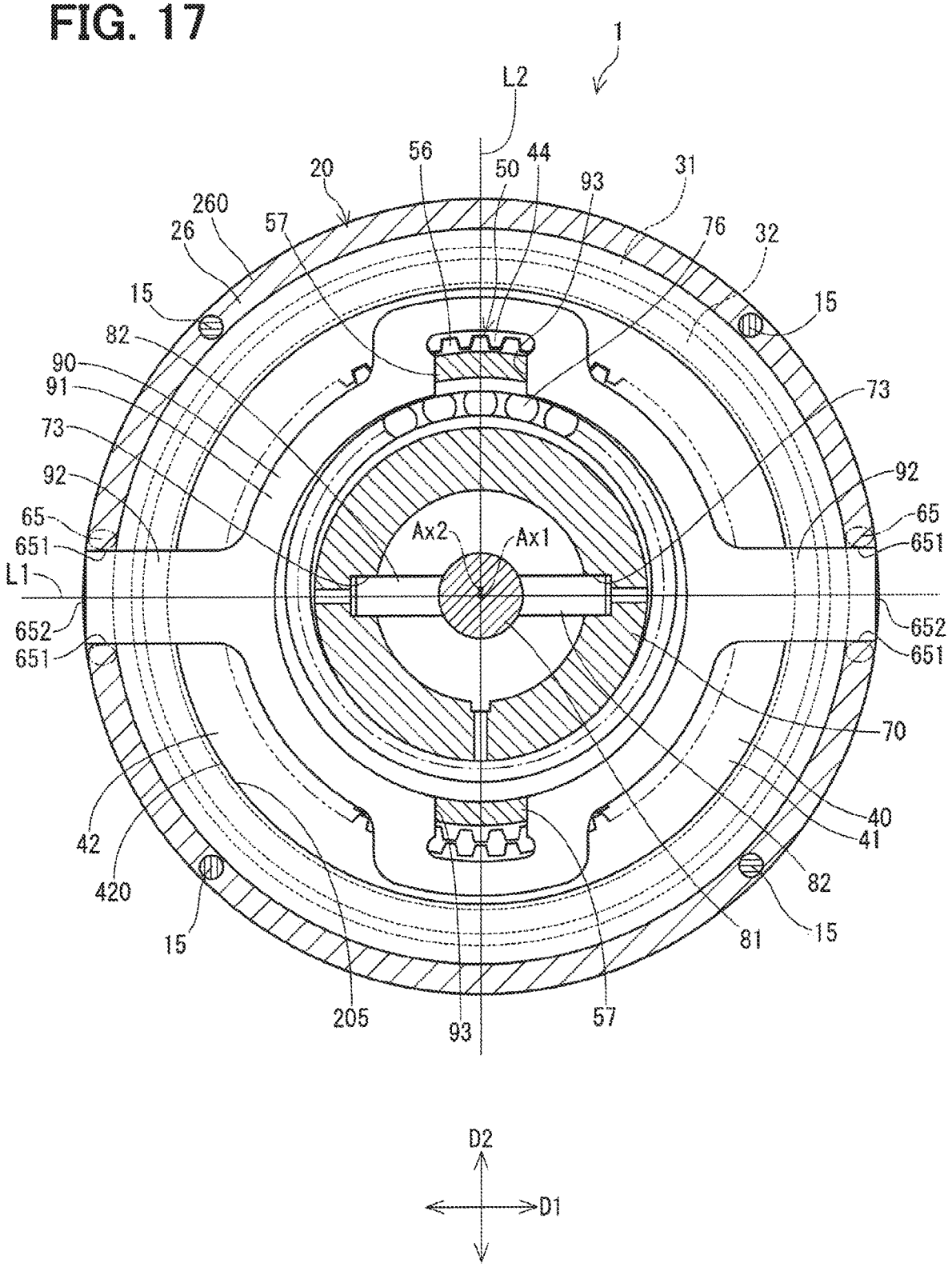
FIG. 17 is a cross-sectional view taken along line XVII-XVII in FIG. 16.

FIGS. 16 and 17 show a valve timing adjustment device according to a fifth embodiment. The fifth embodiment differs from the third embodiment with respect to the location of the engaging portions 65.

As shown in FIGS. 16 and 17, according to the present embodiment, in the view taken in the axial direction of the housing 20, the ring portion 260 of the engaging portion housing 26 is arranged to be placed on the radially outer side of the external teeth arrangement 31. Therefore, in the view taken in the axial direction of the housing 20, each of the engaging portions 65 is placed at the position where the engaging portion 65 does not overlap with the external teeth arrangement 31 and the external teeth arrangement 32. Furthermore, in the view taken in the axial direction of the housing 20, the engaging portions 65 are placed on the radially outer side of the addendum parts 31*c* of the external teeth arrangement 31 that is the radially outermost one among the two external teeth arrangements 31, 32.

As discussed above, (13) according to the present embodiment, in the view taken in the axial direction of the housing 20, the engaging portions 65 are placed on the radially outer side of the addendum parts 31*c* of the external teeth arrangement 31 that is the radially outermost one among the at least one external teeth arrangement. Therefore, it is possible to increase the volume of the space at the inside of the housing 20, and it is possible to give a margin with respect to the size and the packaging of the internal components, such as the gear 50 and the cam plate 40, in the housing 20.

Other Embodiments

In another embodiment, in the state where the cam plate 40 is connected to the camshaft 4, the gap S1, which is shaped into the substantially cylindrical form, may be eliminated between the outer peripheral surface of the camshaft 4 and the inner peripheral surface 210 of the housing 20. Specifically, the housing 20 may be rotatably supported by the outer peripheral surface of the camshaft 4.

In another embodiment, the inner diameter of the first imaginary cylindrical surface VT1 and the inner diameter of the second imaginary cylindrical surface VT2 may be set to be equal to each other. Furthermore, the inner diameter of the first imaginary cylindrical surface VT1 and the inner diameter of the second imaginary cylindrical surface VT2 may be substantially different from each other like in the second comparative example.

In another embodiment, the annular recess 202 may be formed at the contactable surface 201 like in the third comparative example. That is, the contactable surface 201 may not be in the form of planar surface.

In the fifth embodiment, there is exemplified the case where the two external teeth arrangements 31, 32 are formed at the housing 20. Alternatively, in another embodiment, a single external teeth arrangement, such as the external teeth arrangement 31, may be formed at the housing 20. In this case, it is possible to achieve advantages, which are similar to those of the fifth embodiment, as long as the engaging portions 65 are formed on the radially outer side of the addendum parts 31*c* of the external teeth arrangement 31 in the view taken in the axial direction of the housing 20. Furthermore, the number of the external teeth arrangements provided at the housing 20 may be increased to three or more.

Furthermore, in another embodiment, in place of the chain, an endless transmission member, such as a belt, may be used. Furthermore in another embodiment, the number of the endless transmission members may be set to be any number according to the number of the external teeth arrangements.

Furthermore, in the above embodiments, the cam plate 40 is fixed to the end part of the camshaft 4, and the housing 20 is rotated synchronously with the crankshaft 2. Alternatively, in another embodiment, the cam plate 40 may be fixed to the end part of the crankshaft 2, and the housing 20 may be rotated synchronously with the camshaft 4.

The valve timing adjustment device 1 of the present disclosure may be configured to adjust the valve timing of the exhaust valves 12 of the engine 10.

As discussed above, the present disclosure should not be limited to the above embodiments, and the above embodiments may be modified in various forms within the scope of the present disclosure.

What is claimed is:

1. A valve timing adjustment device configured to adjust valve timing of a valve of an internal combustion engine, comprising:

a housing that is rotatable synchronously with one of a driving-side shaft and a driven-side shaft of the internal combustion engine;

a plurality of external teeth arrangements that are respectively shaped into a ring form, wherein the plurality of external teeth arrangements is formed integrally with the housing in one piece and is configured to mesh with a plurality of endless transmission members, respectively, while each of the plurality of endless transmission members is wound around the driving-side shaft or another member that is rotatable;

a cam plate that is connected to another one of the driving-side shaft and the driven-side shaft and is rotatable relative to the housing; and a stopper that is formed integrally with the housing in one piece while the stopper is configured to limit relative rotation between the housing and the cam plate within a predetermined range when a contact surface of the stopper contacts the cam plate, wherein:

the stopper is placed at a position, at which the stopper does not overlap with any one of the plurality of external teeth arrangements in a view taken in an axial direction of the housing.

2. The valve timing adjustment device according to claim 1, further comprising a gear that is configured to mesh with the housing and the cam plate, wherein the gear is configured to be rotated by a motor to make relative rotation between the housing and the cam plate.

3. The valve timing adjustment device according to claim 1, wherein in the view taken in the axial direction of the housing, the stopper is placed on a radially outer side of addendum parts of a radially innermost one of the plurality of external teeth arrangements.

4. The valve timing adjustment device according to claim 3, wherein the cam plate includes a bearing portion that has an outer peripheral surface configured to receive a load, which is applied from an inner peripheral surface of the housing in a radially inward direction.

5. The valve timing adjustment device according to claim 4, wherein in a state where the cam plate and another one of the driving-side shaft and the driven-side shaft are connected with each other, a gap is formed between the housing and another one of the driving-side shaft and the driven-side shaft to limit application of the load from the housing to another one of the driving-side shaft and the driven-side shaft in the radially inward direction.

6. The valve timing adjustment device according to claim 4, wherein:

the housing includes a bearing inner peripheral surface while the bearing inner peripheral surface is opposed to the outer peripheral surface of the bearing portion and extends along a first imaginary cylindrical surface that is cylindrical about an axis of the housing;

the stopper includes a stopper inner peripheral surface while the stopper inner peripheral surface is opposed to an outer peripheral surface of the cam plate and extends along a second imaginary cylindrical surface that is cylindrical about the axis of the housing; and an inner diameter of the first imaginary cylindrical surface is substantially equal to an inner diameter of the second imaginary cylindrical surface.

7. The valve timing adjustment device according to claim 1, wherein:

the housing includes a contactable surface that forms an inner wall of the housing, which is contactable with a wall surface of the cam plate located on one side in the axial direction; and the contactable surface is in a form of a planar surface.

8. The valve timing adjustment device according to claim 1, wherein in the view taken in the axial direction of the housing, the stopper is placed on a radially outer side of addendum parts of a radially innermost one of the plurality of external teeth arrangements and is placed on a radially inner side of dedendum parts of a radially outermost one of the plurality of external teeth arrangements.

9. The valve timing adjustment device according to claim 1, wherein in the view taken in the axial direction of the housing, the stopper is placed on a radially inner side of dedendum parts of a radially innermost one of the plurality of external teeth arrangements.

10. A valve timing adjustment device configured to adjust valve timing of a valve of an internal combustion engine, comprising:

a housing that is rotatable synchronously with one of a driving-side shaft and a driven-side shaft of the internal combustion engine;

a plurality of external teeth arrangements that are respectively shaped into a ring form, wherein the plurality of external teeth arrangements is formed integrally with the housing in one piece and is configured to mesh with a plurality of endless transmission members, respectively, which are wound around the driving-side shaft or another member that is rotatable;

a cam plate that is connected to another one of the driving-side shaft and the driven-side shaft and is rotatable relative to the housing;

an Oldham coupling that is configured to move relative to the housing and thereby implement relative rotation between the housing and the cam plate at a time of inputting rotation from an outside; and an engaging portion that is formed integrally with the housing in one piece, wherein the engaging portion is engageable and is slidable relative to the Oldham coupling, wherein:

the engaging portion is placed at a position, at which the engaging portion does not overlap with any one of the plurality of external teeth arrangements in a view taken in an axial direction of the housing.

11. The valve timing adjustment device according to claim 10, wherein in the view taken in the axial direction of the housing, the engaging portion is placed on a radially outer side of addendum parts of a radially innermost one of the plurality of external teeth arrangements and is placed on a radially inner side of dedendum parts of a radially outermost one of the plurality of external teeth arrangements.

12. The valve timing adjustment device according to claim 10, wherein in the view taken in the axial direction of the housing, the engaging portion is placed on a radially inner side of dedendum parts of a radially innermost one of the plurality of external teeth arrangements.

13. A valve timing adjustment device configured to adjust valve timing of a valve of an internal combustion engine, comprising:

a housing that is rotatable synchronously with one of a driving-side shaft and a driven-side shaft of the internal combustion engine;

at least one external teeth arrangement that is shaped into a ring form, wherein the at least one external teeth arrangement is formed integrally with the housing in one piece and is configured to mesh with at least one endless transmission member, which is wound around the driving-side shaft or another member that is rotatable;

a cam plate that is connected to another one of the driving-side shaft and the driven-side shaft and is rotatable relative to the housing;

an Oldham coupling that is configured to move relative to the housing and thereby implement relative rotation between the housing and the cam plate at a time of inputting rotation from an outside; and an engaging portion that is formed integrally with the housing in one piece, wherein the engaging portion is engageable and is slidable relative to the Oldham coupling, wherein:

the engaging portion is placed on a radially outer side of addendum parts of a radially outermost one of the at least one external teeth arrangement such that the engaging portion does not overlap with any one of the at least one external teeth arrangement in a view taken in an axial direction of the housing.

* * * * *